US009069291B2

(12) United States Patent
Hoshi et al.

(10) Patent No.: US 9,069,291 B2
(45) Date of Patent: Jun. 30, 2015

(54) CARTRIDGE AND UNIT, FOR USE WITH AN IMAGE BEARING MEMBER, HAVING A SEAL MEMBER THAT SEALS A GAP BETWEEN A BLADE MEMBER AND A FRAME

(71) Applicant: CANON KABUSHIKI KAISHA, Tokyo (JP)

(72) Inventors: Nobuharu Hoshi, Yokohama (JP); Fumito Nonaka, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 48 days.

(21) Appl. No.: 13/672,131

(22) Filed: Nov. 8, 2012

(65) Prior Publication Data

US 2013/0129378 A1 May 23, 2013

(30) Foreign Application Priority Data

Nov. 9, 2011 (JP) ..... 2011-245736
Dec. 26, 2011 (JP) ..... 2011-284192
Dec. 26, 2011 (JP) ..... 2011-284193

(51) Int. Cl.
*G03G 15/08* (2006.01)

(52) U.S. Cl.
CPC ..... *G03G 15/0898* (2013.01); *G03G 15/0812* (2013.01)

(58) Field of Classification Search
USPC ..... 399/102–106, 351
See application file for complete search history.

(56) References Cited

U.S. PATENT DOCUMENTS 5,485,249 A 1/1996 Higeta et al.
5,543,898 A * 8/1996 Shishido et al. ..... 399/111
5,740,499 A 4/1998 Higeta et al.
5,809,374 A 9/1998 Tsuda et al.
5,937,237 A 8/1999 Nonaka et al.
6,078,763 A 6/2000 Hoshi
6,101,348 A 8/2000 Nonaka et al.
6,442,359 B1 8/2002 Numagami et al.
6,463,233 B2 10/2002 Kojima et al.

(Continued)

FOREIGN PATENT DOCUMENTS

JP 07005794 A * 1/1995
JP 11272071 10/1999
JP 2002-207409 A 7/2002

OTHER PUBLICATIONS

International Search Report and Written Opinion of the International Searching Authority in International Patent Application No. PCT/JP2012/079577.

*Primary Examiner* — Clayton E Laballe
*Assistant Examiner* — Trevor J Bervik
(74) *Attorney, Agent, or Firm* — Fitzpatrick, Cella, Harper & Scinto

(57) ABSTRACT

A cartridge detachably mountable to a main assembly of an image forming apparatus. The cartridge includes a rotatable member. A blade member, including a rubber portion, is contacted to the rotatable member, with a metal plate portion supported to the blade member. A frame, formed of a resin material, supports the blade member. A seal member, extending in a direction crossing an axial direction of the rotatable member so as to contact the rotatable member, is provided on the frame to be contacted to a portion of the rubber portion and the metal plate portion of the blade member. The seal member is formed on the frame by injection molding for sealing a gap between the blade member and the frame.

50 Claims, 19 Drawing Sheets

(56) References Cited

U.S. PATENT DOCUMENTS

| | | | | |
|---|---|---|---|---|
| 6,577,831 | B1 | 6/2003 | Kojima et al. | |
| 6,721,520 | B2 * | 4/2004 | Higeta et al. | 399/109 |
| 6,823,153 | B2 | 11/2004 | Ueno et al. | |
| 6,826,380 | B2 | 11/2004 | Karakama et al. | |
| 6,865,357 | B2 | 3/2005 | Fujita et al. | |
| 6,873,815 | B2 | 3/2005 | Matsuda et al. | |
| 6,922,534 | B2 | 7/2005 | Goto et al. | |
| 6,990,302 | B2 | 1/2006 | Toba et al. | |
| 7,027,756 | B2 | 4/2006 | Hoshi et al. | |
| 7,072,594 | B2 | 7/2006 | Hoshi et al. | |
| 7,082,276 | B2 | 7/2006 | Karakama et al. | |
| 7,127,194 | B2 | 10/2006 | Hoshi et al. | |
| 7,162,174 | B2 | 1/2007 | Suzuki et al. | |
| 7,162,181 | B2 | 1/2007 | Maeshima et al. | |
| 7,346,293 | B2 | 3/2008 | Suzuki et al. | |
| 7,349,649 | B2 | 3/2008 | Hoshi et al. | |
| 7,627,265 | B2 * | 12/2009 | Gayne et al. | 399/103 |
| 7,865,115 | B2 | 1/2011 | Oguma et al. | |
| 7,873,302 | B2 * | 1/2011 | Kawakami et al. | 399/123 |
| 7,912,404 | B2 | 3/2011 | Hoshi et al. | |
| 7,933,534 | B2 | 4/2011 | Hoshi et al. | |
| 8,301,056 | B2 * | 10/2012 | Matsushita et al. | 399/103 |
| 2009/0245851 | A1 | 10/2009 | Hoshi et al. | |
| 2010/0189482 | A1 * | 7/2010 | Azuma et al. | 399/351 |
| 2011/0170903 | A1 | 7/2011 | Hoshi et al. | |
| 2013/0022368 | A1 | 1/2013 | Takarada et al. | |

* cited by examiner

CARTRIDGE AND UNIT, FOR USE WITH AN IMAGE BEARING MEMBER, HAVING A SEAL MEMBER THAT SEALS A GAP BETWEEN A BLADE MEMBER AND A FRAME

CLAIM OF PRIORITY

This application claims priority from Japanese Patent Application No. 2011-245736, filed Nov. 9, 2011, No. 2011-284192, filed Dec. 26, 2011, and No. 2011-284193, filed Dec. 26, 2011, which are hereby incorporated by reference.

FIELD OF THE INVENTION AND RELATED ART

The present invention relates to a cartridge detachably mountable to an electrophotographic image forming apparatus main assembly and a unit for use with an electrophotographic image forming apparatus.

In a conventional electrophotographic image forming apparatus using an electrophotographic image forming process, an electrophotographic photosensitive member and a process means acting on the electrophotographic photosensitive member are integrally assembled into a unit to prepare a process cartridge. Further, a type in which the process cartridge is detachably mountable to the image forming apparatus main assembly is employed.

In such a process cartridge, in order to prevent a developer (toner) accommodated in the process cartridge from leaking out to the outside, the process cartridge is configured to seal between cartridge frames and between parts, for constituting the process cartridge, with a plurality of seal members.

For example, in a cleaning unit including a cleaning blade for removing a residual developer (residual toner) remaining on an electrophotographic photosensitive member, a seal member as described below is provided. The seal member is used for preventing leakage of the residual toner from a gap between a cartridge frame and the cleaning blade to the outside of the process cartridge. As such a seal member, an under cleaning blade seal for sealing the gap between the cartridge frame and the cleaning blade in contact with the cleaning blade over a longitudinal direction of the cartridge frame is provided. Further, vertical seals for sealing a gap between the cartridge frame and the cleaning blade in contact with the cleaning blade at longitudinal end portions of the cartridge frame are provided.

Here, as the seal member, an elastic member such as urethane foam, soft rubber, or elastomer resin is used. The seal member is bonded to a bonding portion between the frames or between the parts with high accuracy (Japanese Laid-Open Patent Application (JP A) Hei 11 272071).

In recent years, in order to realize cost reduction by an increase in manufacturing efficiency and to realize stability of quality during assembling, manufacturing of the process cartridge has been made, in place of a manual assembling operation, by an automatic machine using a device in each of the assembling steps. Also, with respect to the seal member, assembling by an automatic machine has been effected.

However, the conventional constitutions described above were accompanied with the following problems. That is, the seal member is a soft part and, therefore, it is difficult to hold the seal member by the automatic machine (robot), so that it is difficult to apply the seal member onto the cartridge frame with high accuracy. Further, it is difficult to assemble the seal member with the cartridge frame by the automatic machine.

For this reason, there is a possibility that a toner seal property is lowered.

SUMMARY OF THE INVENTION

The present invention has been accomplished in view of the above-described circumstances. A principal object of the present invention is to provide a cartridge and a unit that are capable of improving an assembling property when a seal member is assembled with a frame by an automatic machine and that are also capable of realizing the assembling with high accuracy to improve a toner seal property.

According to one aspect, the present invention provides a cartridge detachably mountable to a main assembly of an image forming apparatus. The cartridge comprises a rotatable member, a blade member contacted to the rotatable member, a frame, formed of a resin material, for supporting the blade member, and a seal member provided in the frame to be contacted to a portion of the blade member, opposite from a portion where the blade member is contacted to the rotatable member, in each of one end side and another end side of the blade member with respect to an axial direction of the rotatable member, wherein the seal member is formed on the frame by injection molding for sealing a gap between the blade member and the frame.

According to another aspect, the present invention provides a unit for use with an image forming apparatus, comprising a blade member contacted to a rotatable member, a frame, formed of a resin material, for supporting the blade member, and a seal member provided in the frame to be contacted to a portion of the blade member, opposite from a portion where the blade member is contacted to the rotatable member, in each of one end side and another end side of the blade member with respect to an axial direction of the rotatable member, wherein the seal member is formed on the frame by injection molding for sealing a gap between the blade member and the frame.

These and other objects, features, and advantages of the present invention will become more apparent upon a consideration of the following description of the preferred embodiments of the present invention taken in conjunction with the accompanying drawings.

Figure 8:
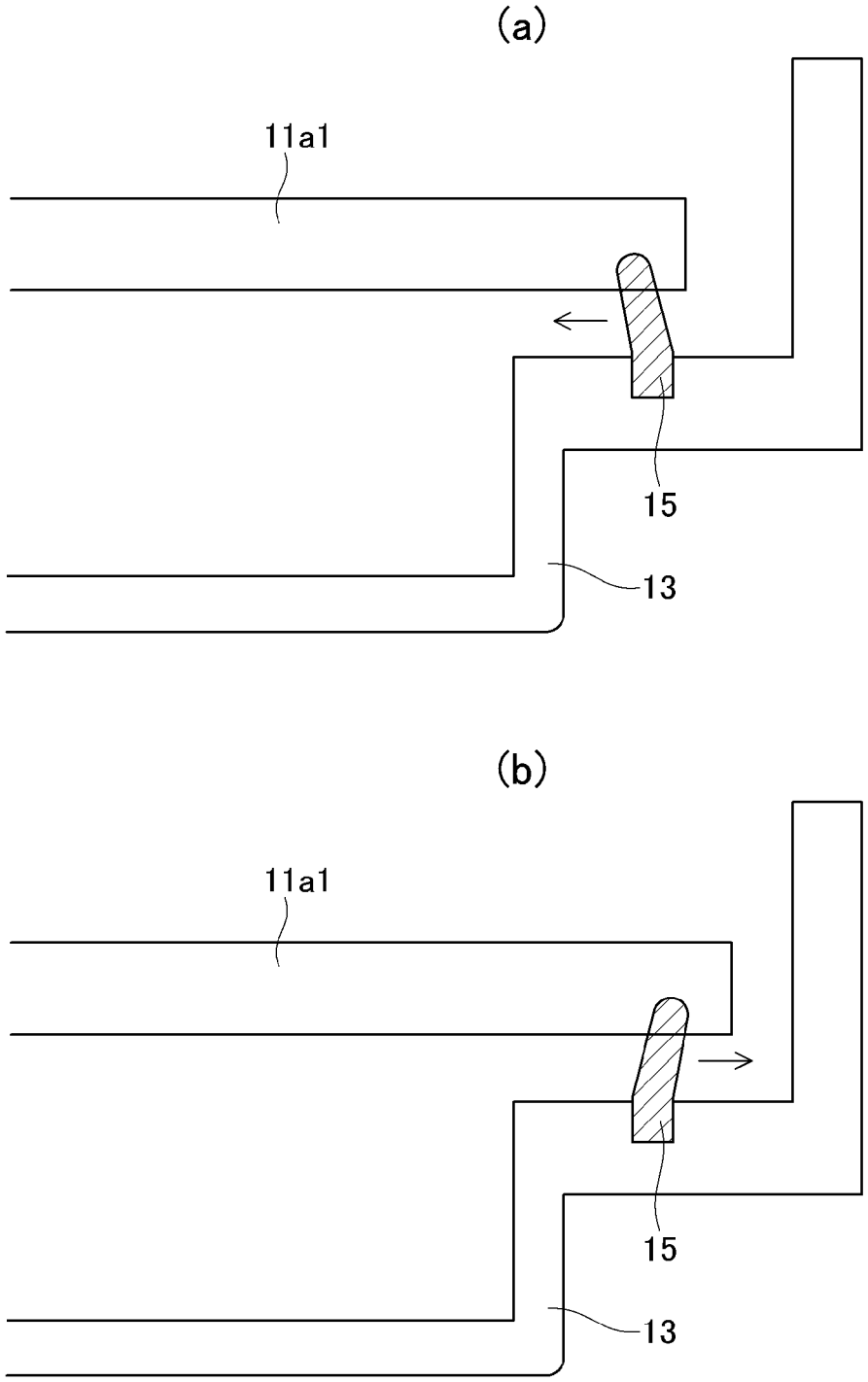

Parts (a) and (b) of FIG. 8 are schematic sectional views showing a cross-sectional shape of the vertical seal in the Embodiment.

Figure 9:
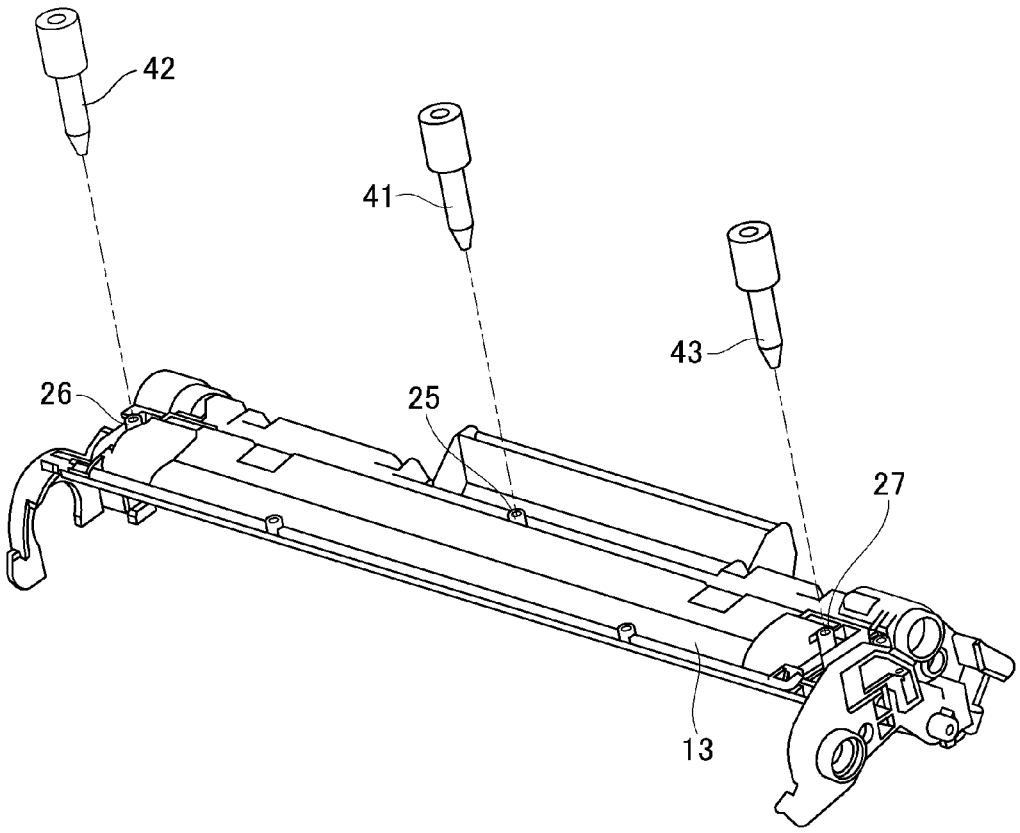

FIG. 9 is a schematic perspective view showing injection parts of a cleaning container in the Embodiment.

Figure 10:
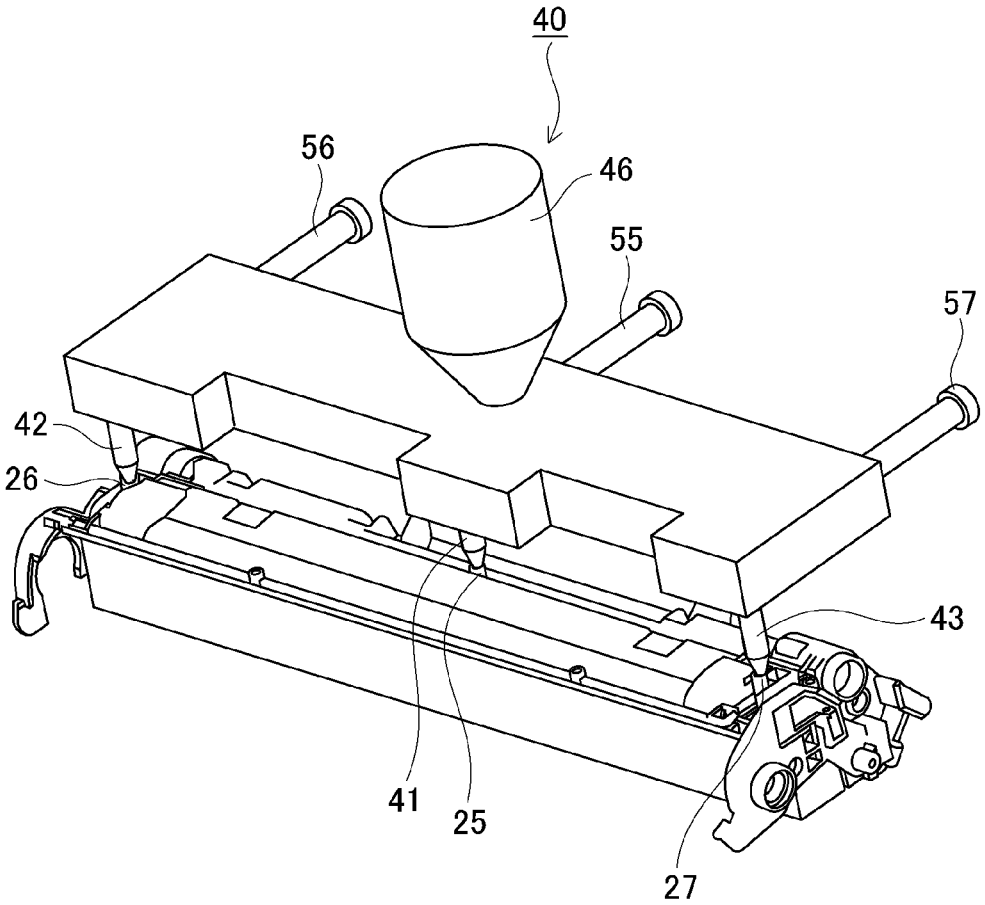

FIG. 10 is a schematic perspective view showing a state in which the cleaning container is set in a resin material injection device in the Embodiment.

Figure 11:
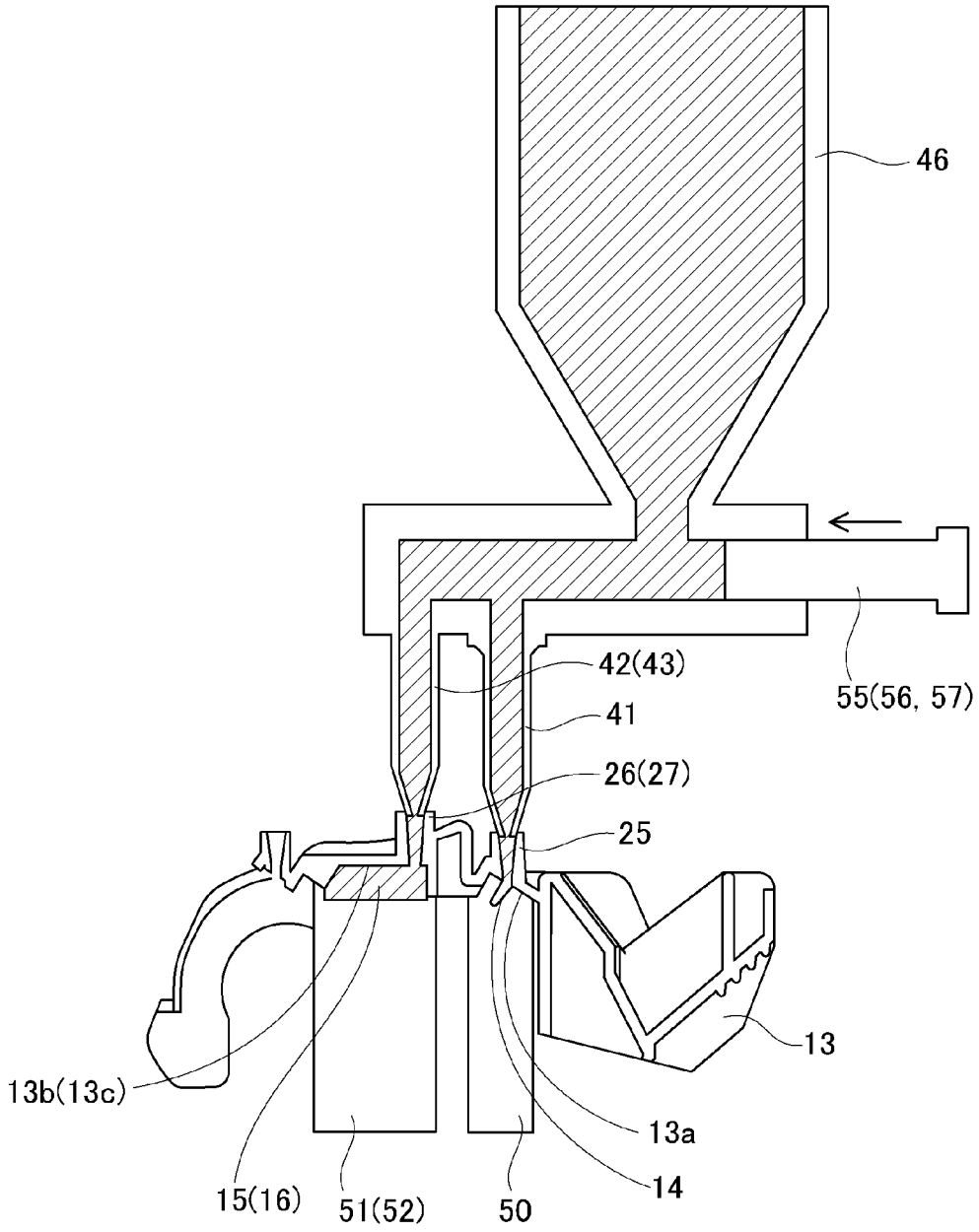

FIG. 11 is a schematic view showing a state in which a resin material is injected for molding into the cleaning container in the Embodiment.

Figure 12:
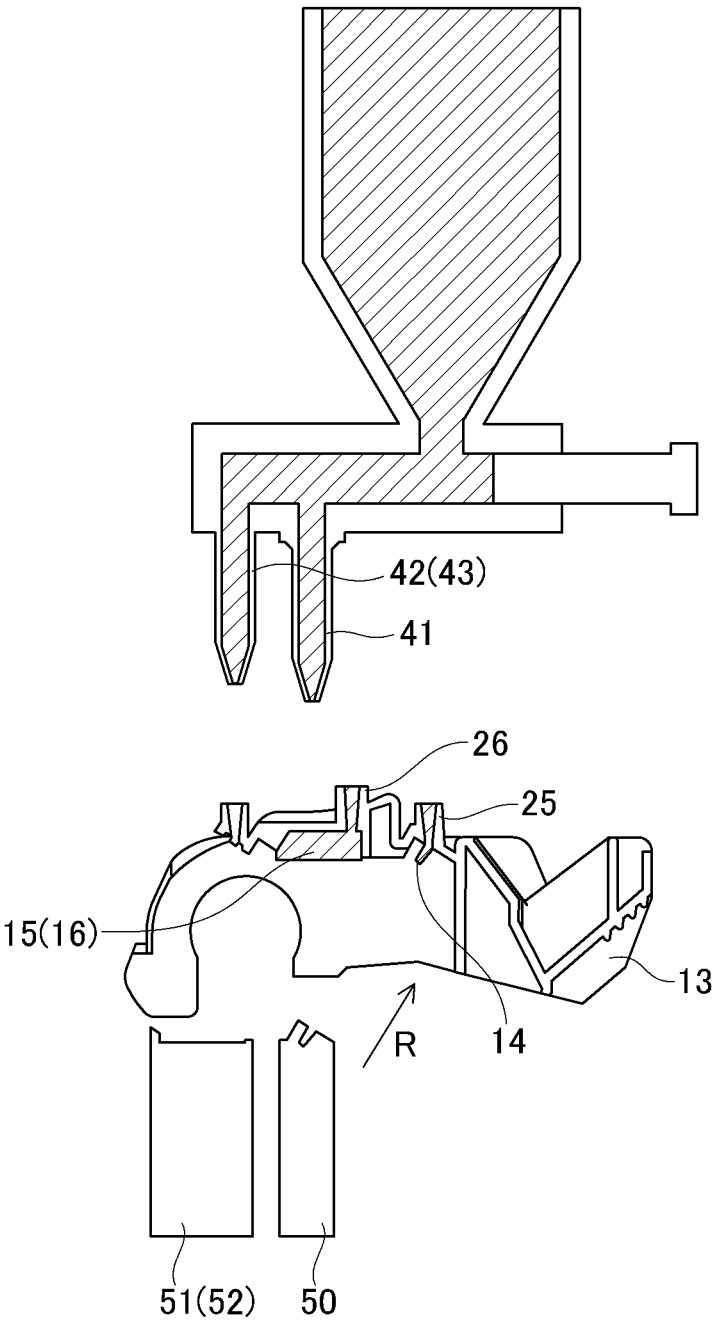

FIG. 12 is a schematic view showing a state after the resin material is injected and molded in the cleaning container in the Embodiment.

Figure 13:
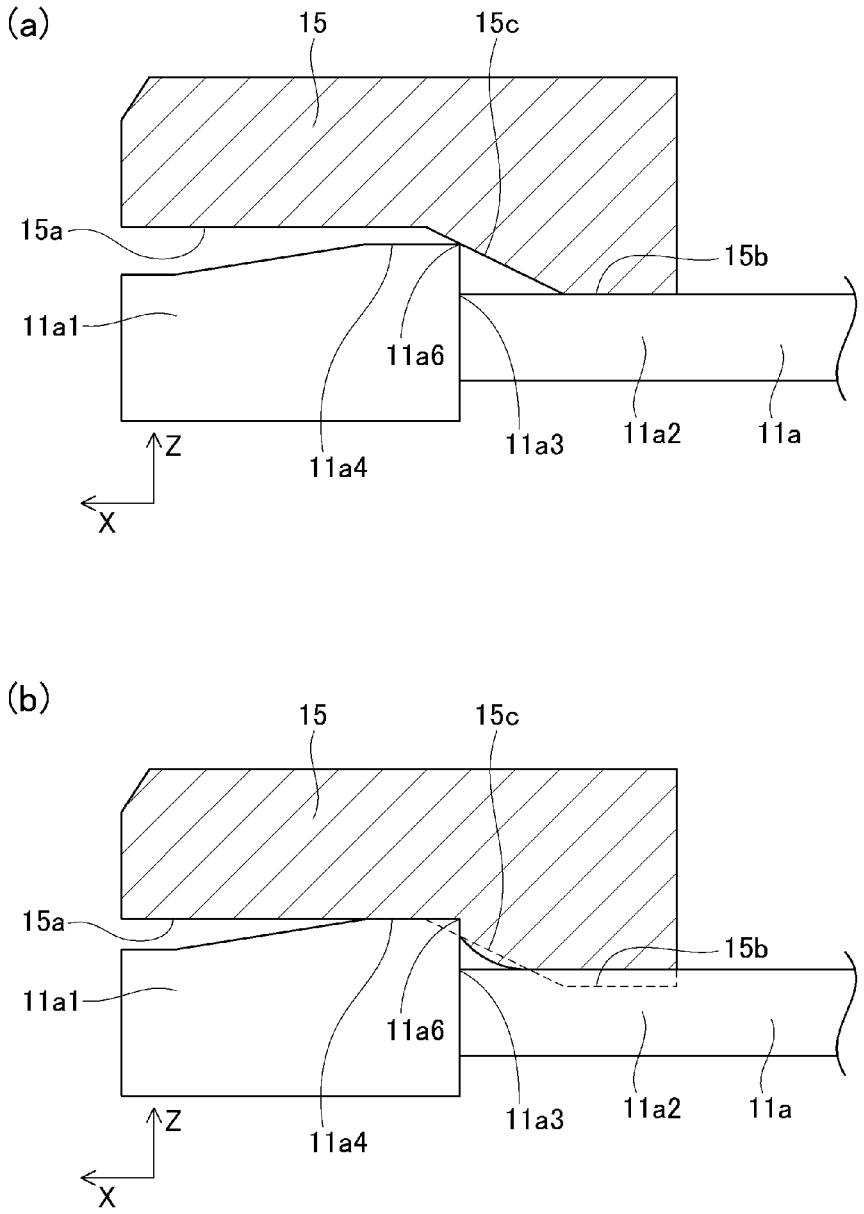

Parts (a) and (b) of FIG. 13, (a) and (b) of FIG. 14, FIG. 15, FIG. 16, and FIG. 17 are schematic sectional views each showing the vertical seal of the cleaning frame unit and its neighborhood in the Embodiment.

Figure 18:
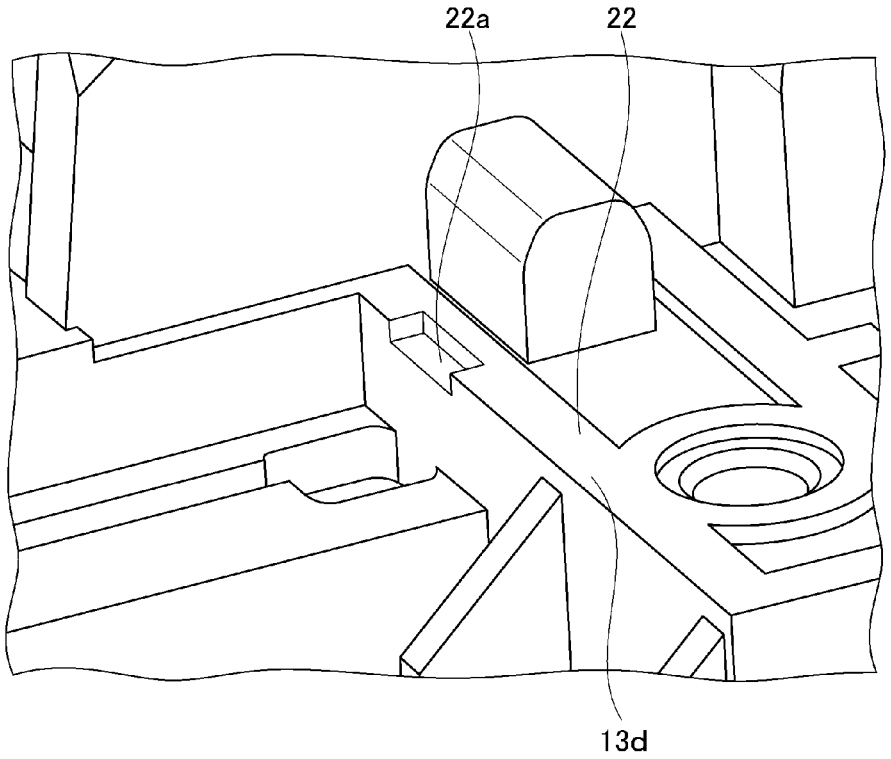

FIG. 18 is a schematic perspective view showing a cleaning blade mounting bearing surface in the Embodiment.

Figure 19:
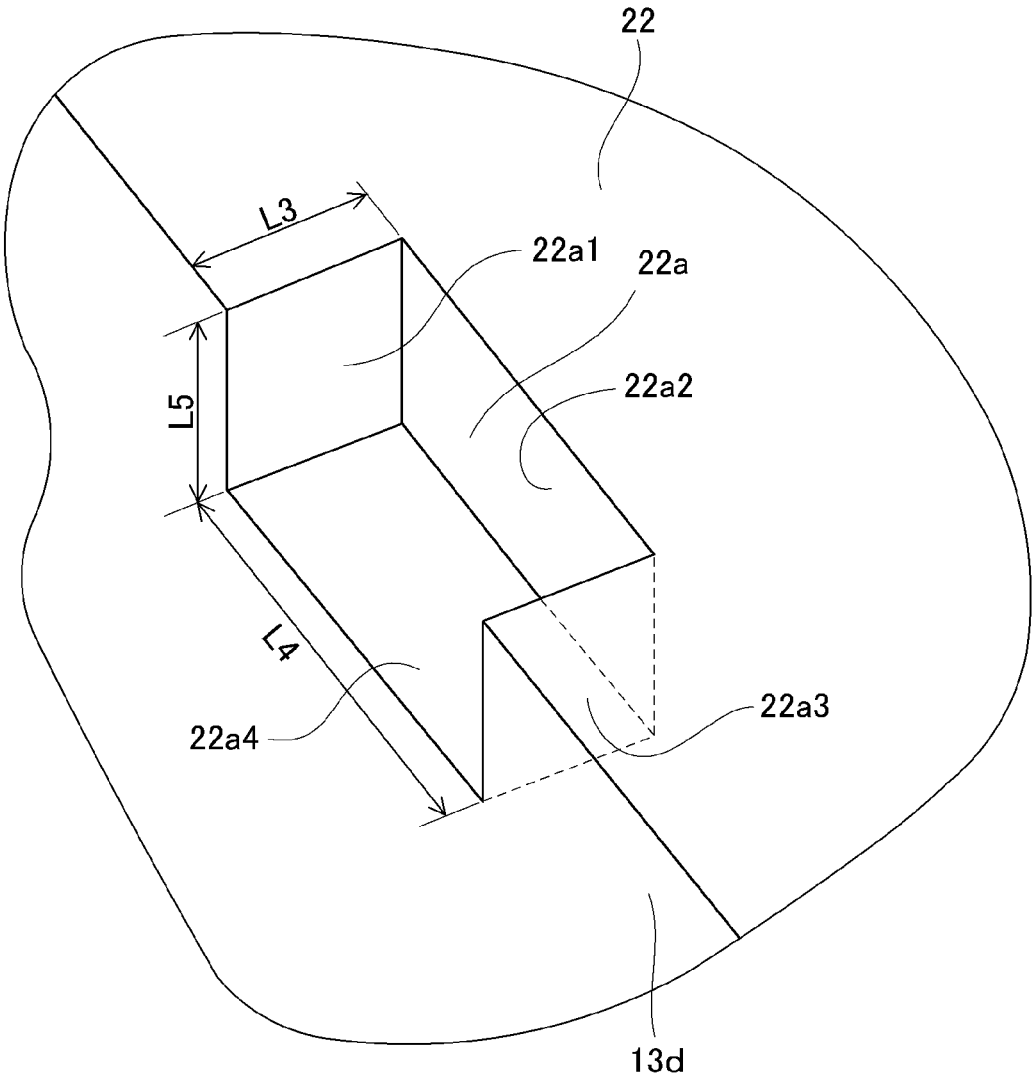

FIG. 19 is an enlarged perspective view showing the cleaning blade mounting bearing surface in the Embodiment.

Figure 20:
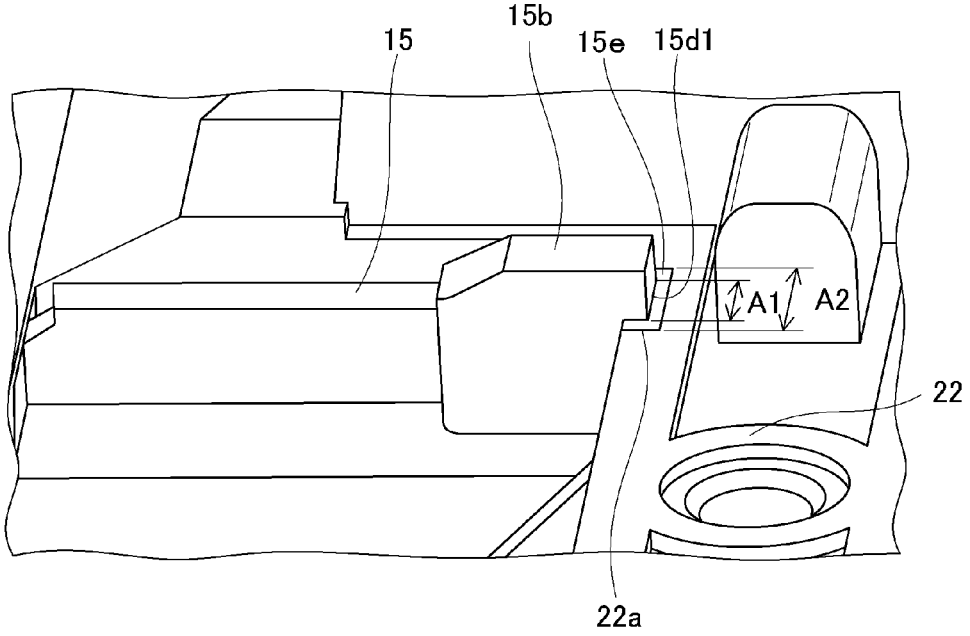

FIG. 20 is a schematic perspective view showing the vertical seal of the cleaning frame unit and its neighborhood in the Embodiment.

Figure 21:
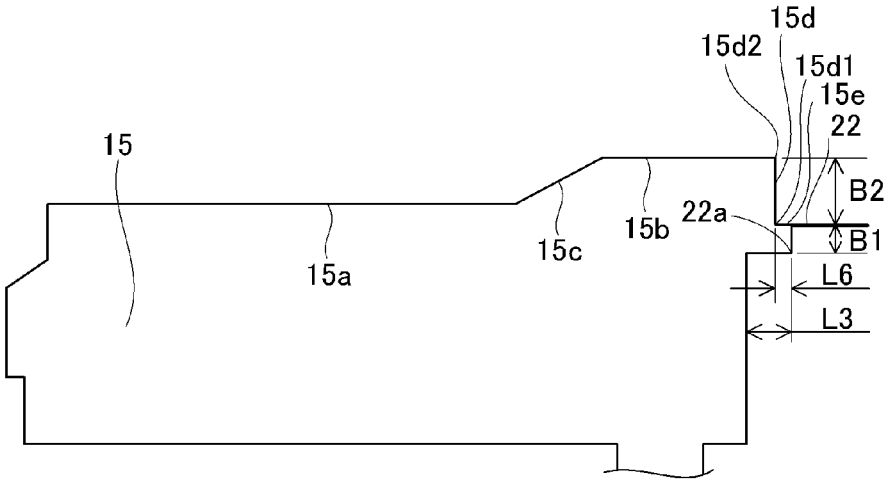
Figure 22:
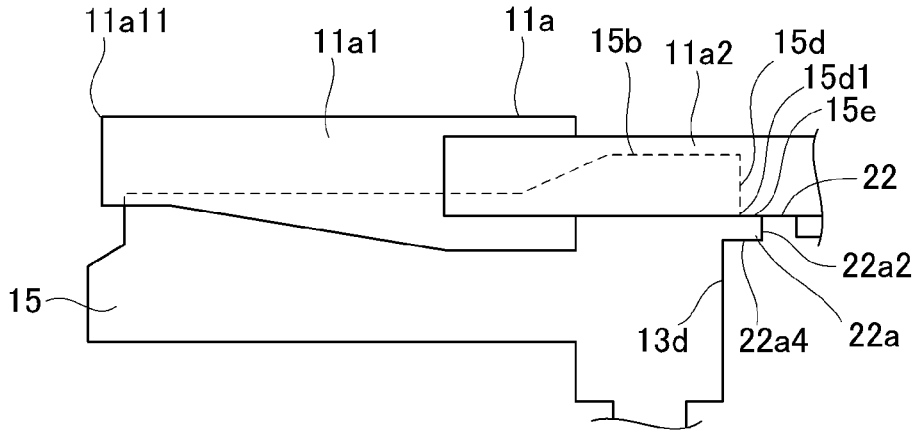
Figure 23:
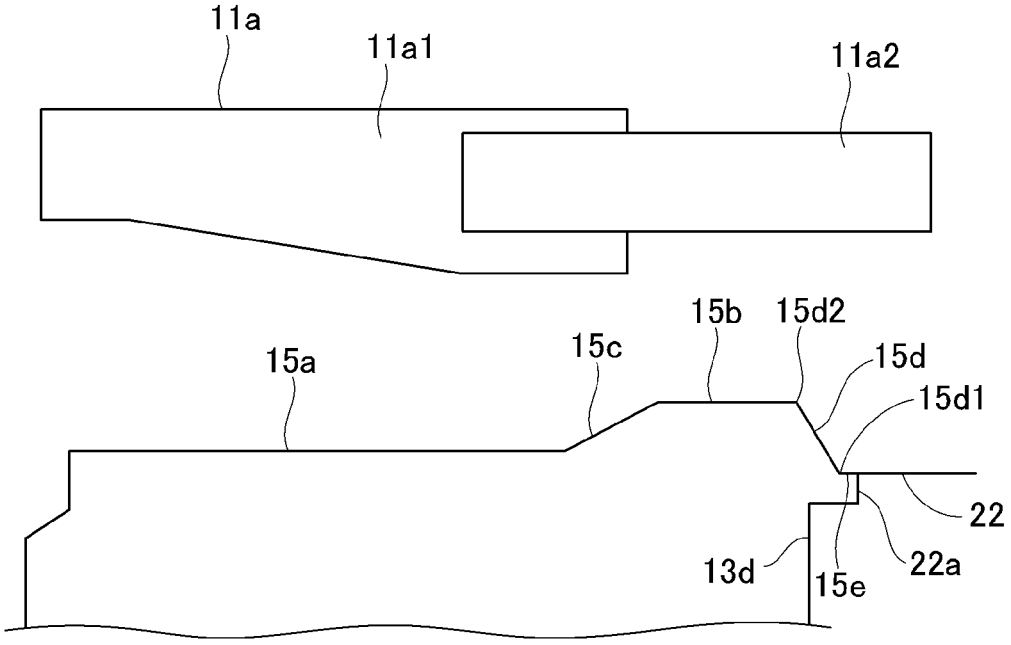

FIGS. 21, 22, and 23 are schematic sectional views each showing the vertical seal of the cleaning frame unit and its neighborhood in the Embodiment.

DESCRIPTION OF THE PREFERRED EMBODIMENTS

Embodiments for carrying out the present invention now will be exemplarily and specifically described, with reference to the drawings. However, dimensions, materials, shapes, relative arrangements, and the like, of constituent elements described in the following embodiments are appropriately changed depending on constitutions or various conditions of devices (apparatuses) to which the present invention is applied and, thus, the scope of the present invention is not limited thereto.

The present invention relates to a cartridge detachably mountable to a main assembly of an electrophotographic image forming apparatus. Here, the electrophotographic image forming apparatus forms an image on a recording material by using an image forming process of an electrophotographic type. Examples of the electrophotographic image forming apparatus may include an electrophotographic copying machine, an electrophotographic printer (such as a laser beam printer or an LED printer), a facsimile machine, and a word processor. Further, the cartridge is a generic name for a drum cartridge for supporting an electrophotographic photosensitive drum (electrophotographic photosensitive member), a developing cartridge for supporting a developing means, a process cartridge prepared by assembling the electrophotographic photosensitive drum and a process means into a cartridge (unit), and the like, cartridge. The process means acts on the electrophotographic photosensitive drum, and examples thereof may include a charging means, the developing means, a cleaning means, and the like, which act on the electrophotographic photosensitive drum.

Embodiment

An image forming apparatus and a process cartridge in this embodiment will be specifically described below with reference to the drawings. In the following description, a longitudinal direction is a direction (rotational axis direction of a photosensitive drum) crossing (substantially perpendicular to) a direction in which the process cartridge is mounted into an image forming apparatus main assembly.

(General Structure)

Figure 1:
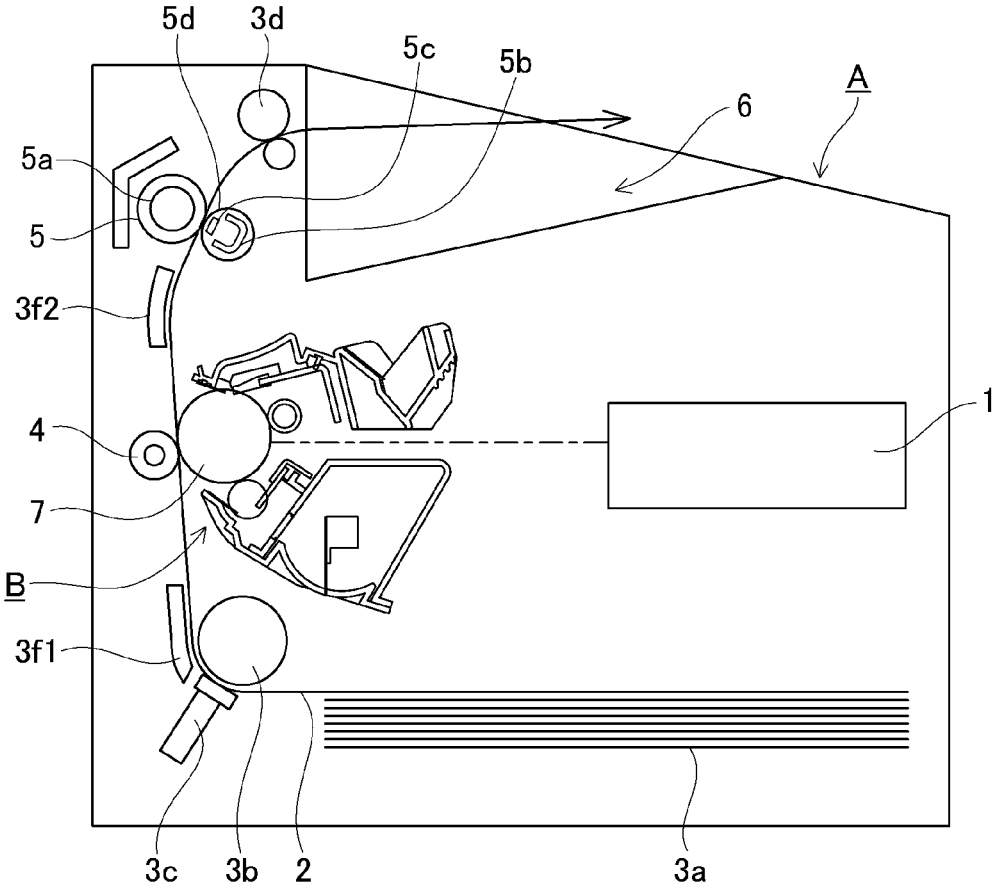
FIG. 1 is a schematic sectional view showing a general structure of an image forming apparatus in one Embodiment.
Figure 2:
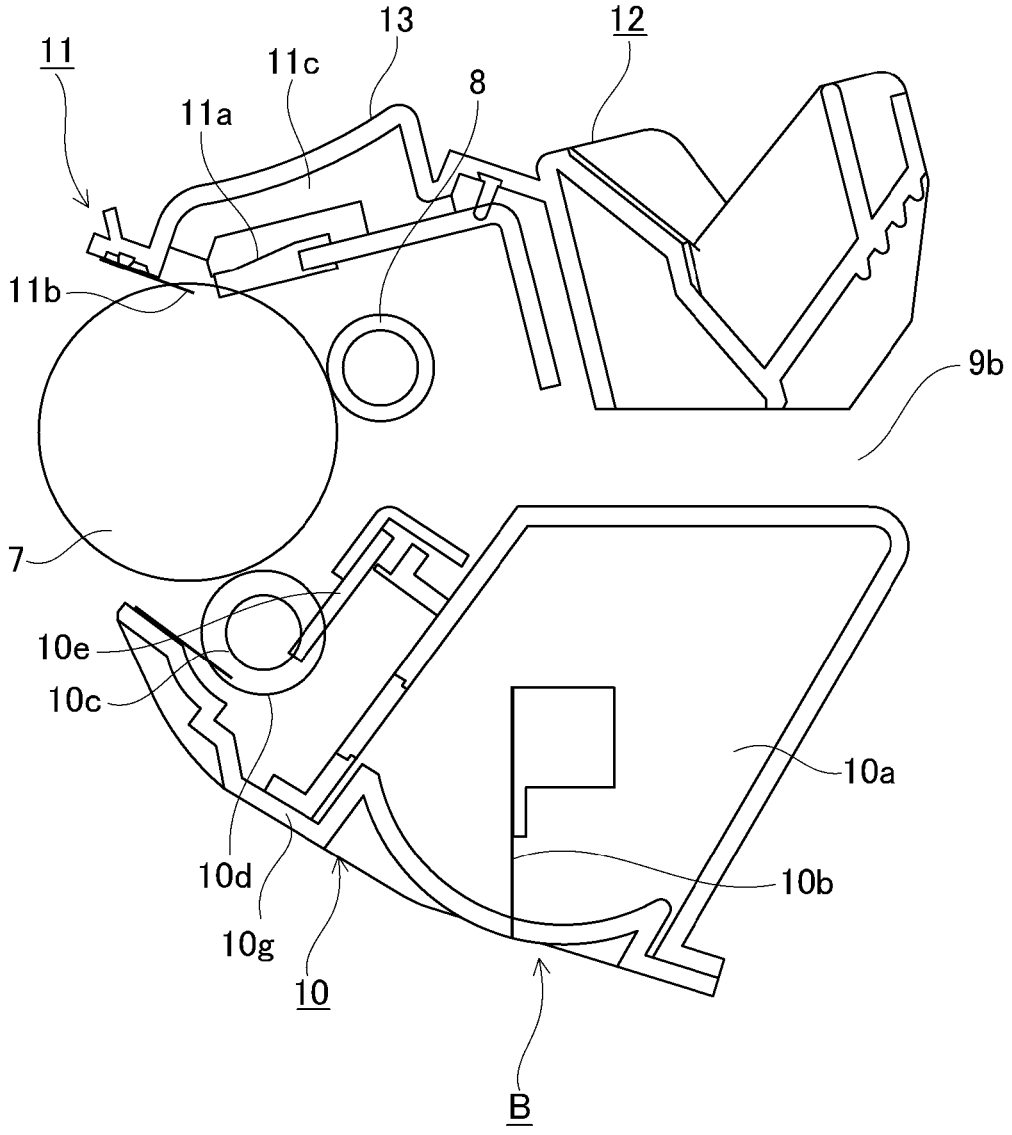
FIG. 2 is a schematic sectional view of a process cartridge in the Embodiment.

A general structure of each of the image forming apparatus and the process cartridge will be described with reference to FIGS. 1 and 2. FIG. 1 is a schematic sectional view showing a general structure of a laser beam printer as an example of the image forming apparatus in this embodiment, and FIG. 2 is a schematic sectional view of the process cartridge in this embodiment.

The general structure of an image forming apparatus main assembly A will be described. First, a drum shaped electrophotographic photosensitive member (image bearing member as a rotatable member, hereafter referred to as a photosensitive drum) 7 is irradiated with information light, on the basis of image information, emitted from an optical system as an optical means. As a result, an electrostatic latent image is formed on the photosensitive drum 7 and then is developed with a developer (hereafter referred to as a toner), so that a toner image is formed on a surface of the photosensitive drum (image bearing member) 7. In synchronism with the toner image formation, sheets of a recording material (e.g., a recording medium, such as recording paper, an OHP sheet, or cloth) 2 are separated and fed one by one from a feeding portion (cassette) 3*a* by a pick-up roller 3*b* and a press-contact member 3*c* press-contacted to the pick-up roller 3*b*. Then, by applying a voltage to a transfer roller 4 as a transfer means, the toner image formed on the photosensitive drum 7 of a process cartridge B is transferred onto the recording material 2 fed along a feeding guide 3*f*1.

Then, the recording material 2, on which the toner image is transferred, is conveyed to a fixing means 5 along a conveying guide 3*f*2. The fixing means 5 includes a driving roller 5*a* and a rotatable fixing member 5*d* that incorporates therein a heater 5*b* and is constituted by a cylindrical sheet rotatably supported by a supporting member 5*c*, and fixes the toner image on the passing recording material 2 under application of heat and pressure. The recording material 2 on which the toner image is fixed is conveyed by a discharging roller 3*d* and then is discharged on a discharge portion 6 via a reverse conveyance path. In this embodiment, a conveying (feeding) means 3 is constituted by the pick-up roller 3*b*, the press-contact member 3*c*, the discharging roller 3*d*, and the like, but is not limited thereto.

(Structure of the Process Cartridge)

The process cartridge B includes, as shown in FIG. 2, the photosensitive drum 7 and at least one process means. Examples of the process means may include a charging means for electrically charging the photosensitive drum 7, a developing means for developing the electrostatic latent image formed on the photosensitive drum 7, and a cleaning means for removing the toner (e.g., residual toner, waste toner, or residual developer) remaining on the photosensitive drum 7 (image bearing member).

In the process cartridge B in this embodiment, as shown in FIG. 2, the rotatable photosensitive drum 7 having a photosensitive layer is rotationally driven, and its surface is uniformly charged by voltage application to a charging roller 8 as the charging means. The process cartridge B is constituted so that the photosensitive drum 7 in a charged state is exposed, via an exposure opening 9*b*, to the information light (light image), on the basis of the image information, emitted from the optical system 1, thereby to form the electrostatic latent image on the surface of the photosensitive drum 7 and, then, the electrostatic latent image is developed by the developing means.

A developing operation by the developing means will be described. First, the toner in a toner accommodating portion 10*a* is fed toward a developing roller 10*d*, in which a fixed magnet 10*c* is incorporated, as a rotatable developing member (developer carrying member) by a rotatable feeding member 10*b* as a toner feeding means. Then, by rotating the developing roller 10*d*, a toner layer to which triboelectric charges are imparted is formed on the surface of the developing roller 10*d*. Further, the developing blade 10*e* regulates, as a developer layer thickness regulating member, the layer thickness of the toner borne by the surface of the developing roller 10*d* (developer carrying member). Then, the toner is transferred from the surface of the developing roller 10*d* onto the photosensitive drum 7, depending on the electrostatic latent image, so that the toner image is formed on (borne by) the photosensitive drum 7 and, thus, the electrostatic latent image is visualized.

Then, by applying to the transfer roller 4 a voltage of an opposite polarity to a charge polarity of the toner image, the toner image is transferred from the photosensitive drum 7 onto the recording material 2. The toner remaining on the photosensitive drum 7 after the transfer is scraped off by a cleaning blade 11*a* as a blade member (cleaning means) and is accommodated in a residual toner accommodating portion (developer accommodating portion) 11*c*. A receptor sheet 11*b* as a thin plate member is provided to contact the photosensitive drum 7, so that the toner accommodated in the residual toner accommodating portion 11*c* is prevented from leaking out of the residual toner accommodating portion 11*c*.

The process cartridge B is constituted by a photosensitive drum unit 11 and a developing unit 10. The photosensitive drum unit 11 includes the photosensitive drum 7, the charging roller 8, the cleaning blade 11*a*, the receptor sheet 11*b*, and a cartridge frame unit 12. The cleaning blade 11*a* is constituted by a rubber portion 11*a*1, which is a blade contacted to the photosensitive drum 7, and a metal plate portion 11*a*2, which is a supporting portion for supporting the rubber portion 11*a*1. The metal plate portion 11*a*2 is provided along a rotational axis direction of the photosensitive drum 7. The rubber portion 11*a*1 is supported by the metal plate portion 11*a*2 to contact the photosensitive drum 7 and is formed so as to cover a part of the metal plate portion 11*a*2 and so as to extend toward the photosensitive drum 7.

The developing unit 10 includes the developing means, a developing (device) frame constituting the toner accommodating portion 10*a*, and a developing container. The developing means is constituted by the developing roller 10*d*, the developing blade 10*e*, and the like.

(Seal Constitution of Cleaning Frame Unit)

Figure 3:
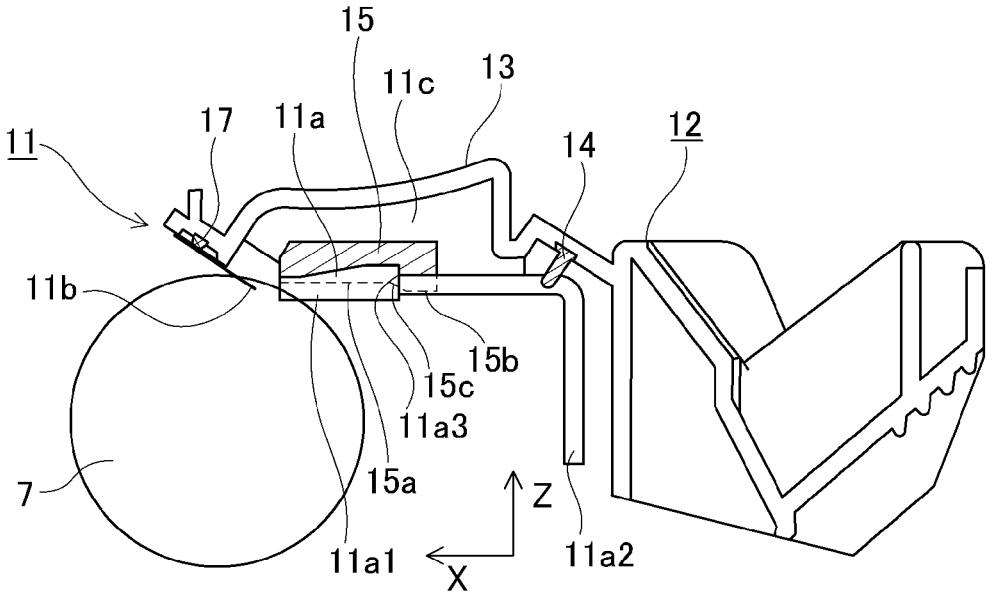
FIG. 3 is a schematic sectional view of a photosensitive drum unit in the Embodiment.
Figure 4:
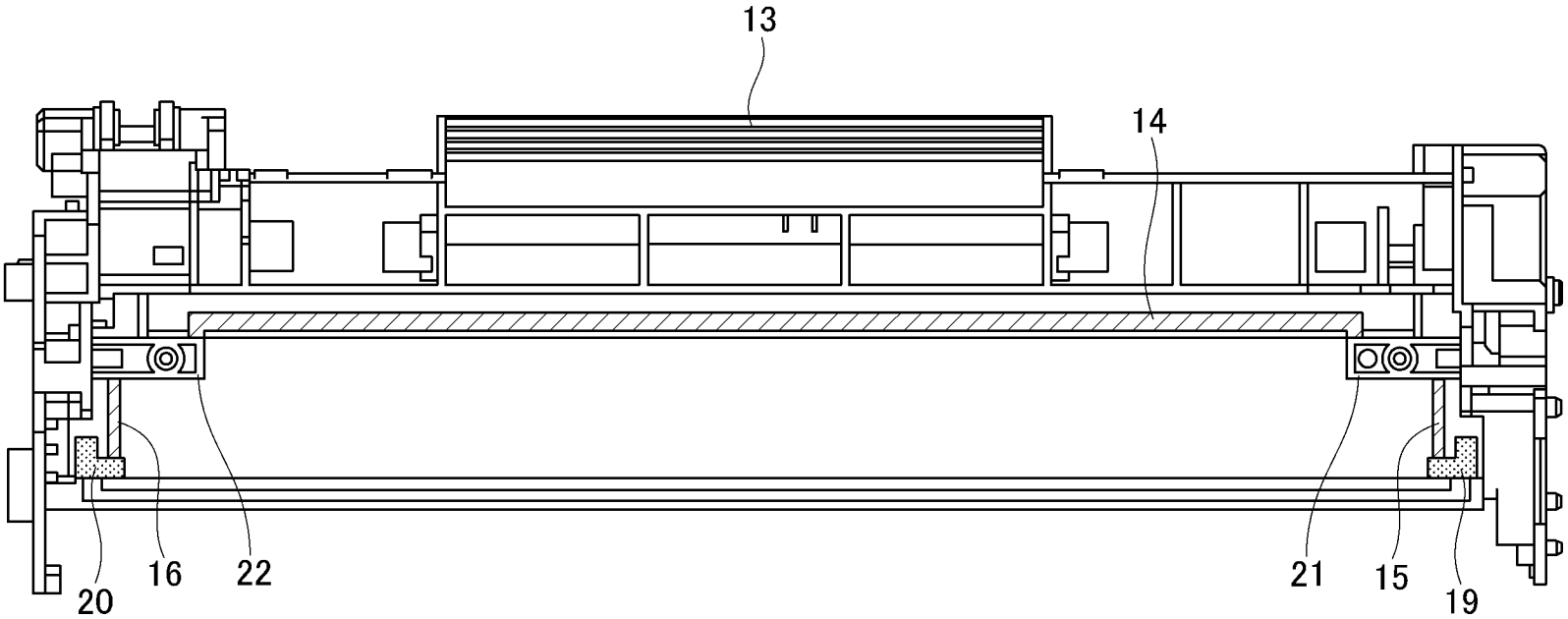
FIG. 4 is a schematic front view of a seal constitution of a cleaning frame unit in the Embodiment.
Figure 5:
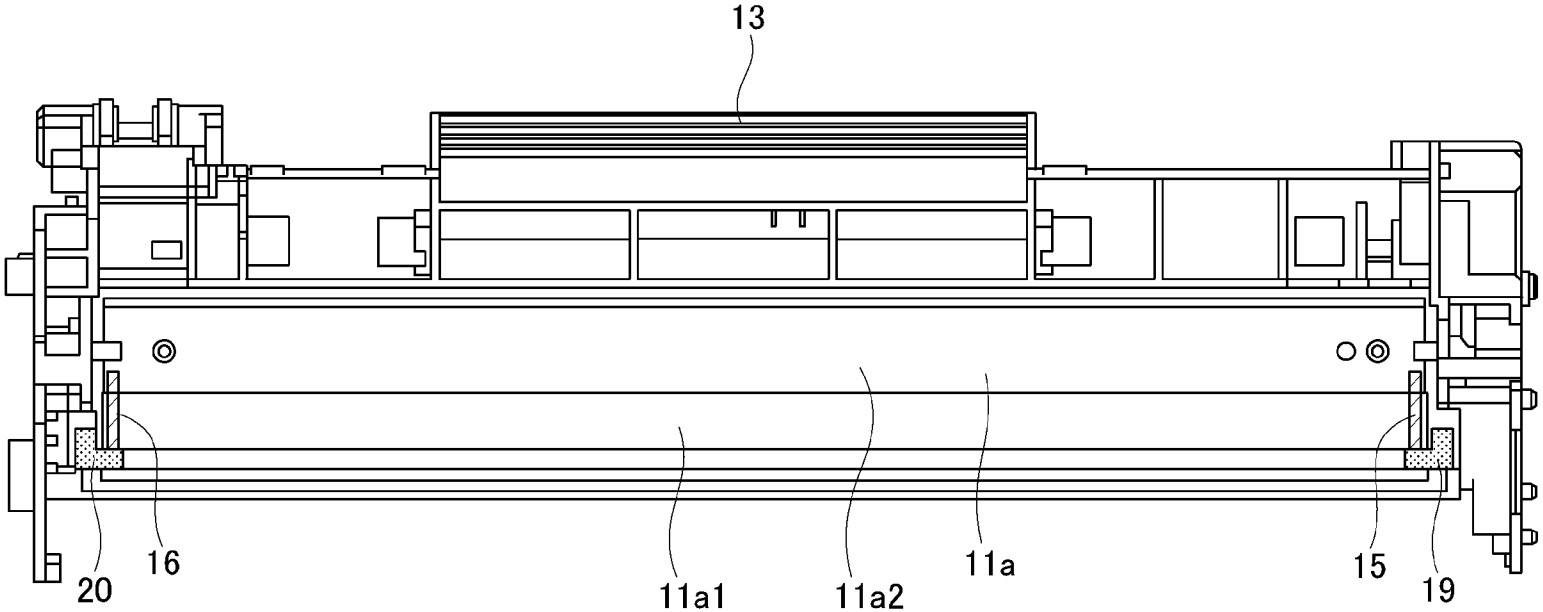
FIG. 5 is a schematic front view of the cleaning frame unit in the Embodiment.
Figure 6:
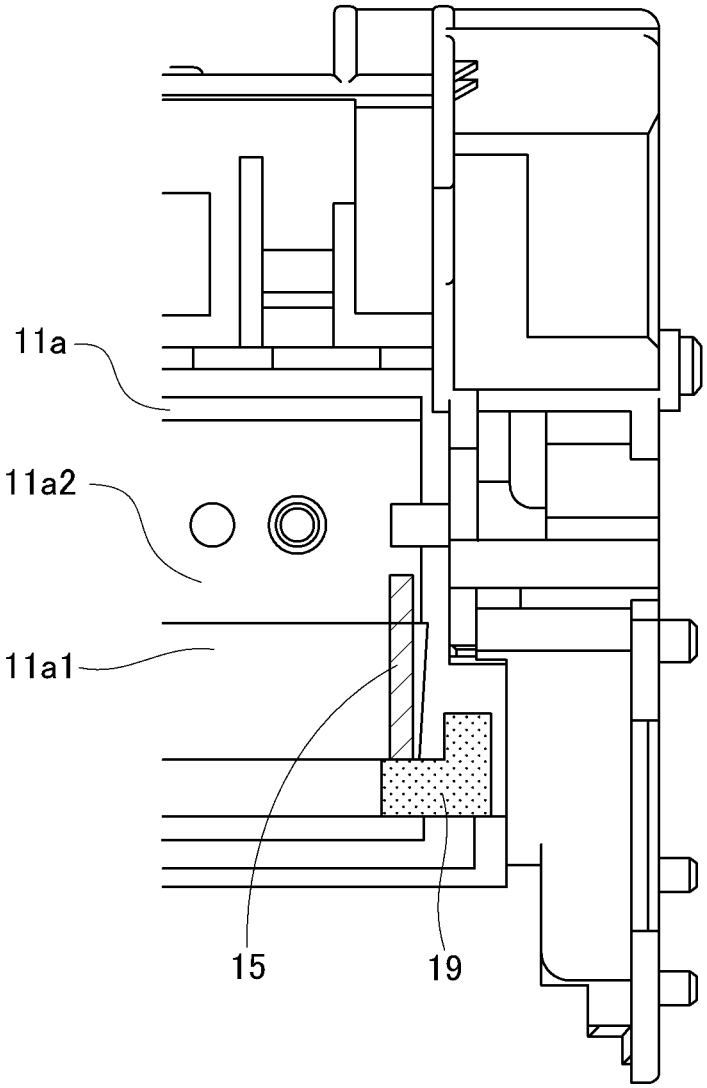
FIG. 6 is a schematic front view of a vertical seal of the cleaning frame unit and its neighborhood in the Embodiment.
Figure 7:
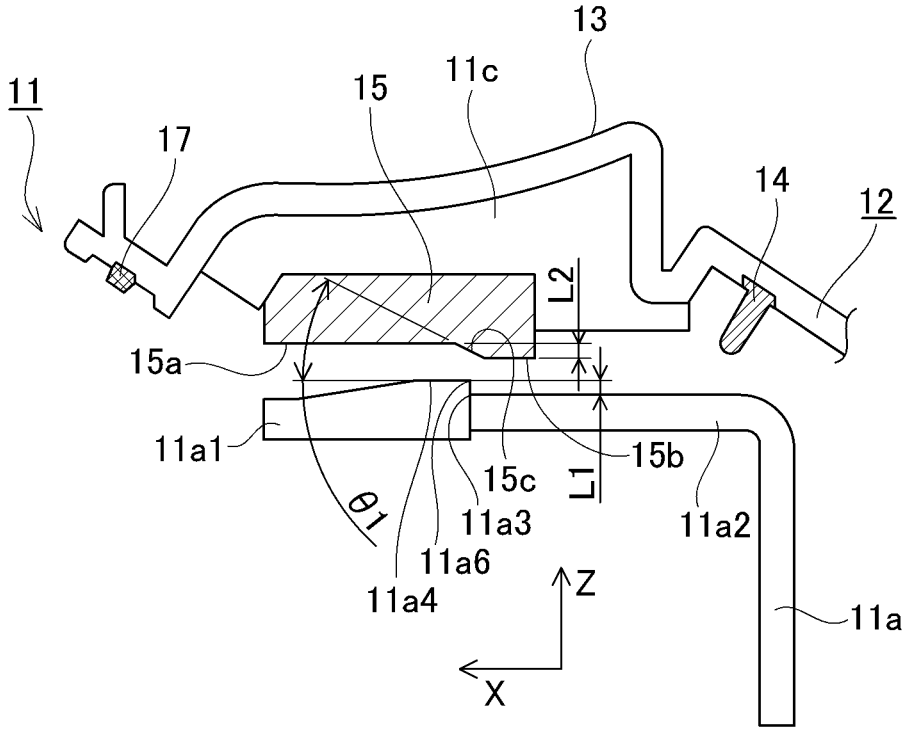
FIG. 7 is a schematic sectional view of the vertical seal of the cleaning frame unit and its neighborhood in the Embodiment.

A seal constitution (structure) of the cleaning frame unit in this embodiment will be specifically described with reference to FIGS. 3 to 8. FIG. 3 is a schematic sectional view of a photosensitive drum unit in this embodiment. FIG. 4 is a schematic front view of a seal constitution of a cleaning frame unit in this embodiment. FIG. 5 is a schematic front view of the cleaning frame unit in a state in which the cleaning blade is mounted in this embodiment. FIG. 6 is a schematic front view of a vertical seal of the cleaning frame unit and its neighborhood in this embodiment. FIG. 7 is a schematic sectional view of the vertical seal of the cleaning frame unit and its neighborhood in this embodiment. Parts (a) and (b) of FIG. 8 are schematic sectional views showing a cross-sectional shape of the vertical seal in this embodiment.

As shown in FIGS. 3 and 4, the cleaning frame unit 12 includes a cleaning container 13 including the residual toner accommodating portion 11*c* and includes the cleaning blade 11*a*, an under-cleaning blade seal 14, vertical seals 15 and 16, and end portion seals 19 and 20. The under-cleaning blade seal 14 and the vertical seals 15 and 16 are used, as a seal member for preventing leakage of the residual toner, for sealing a gap between the cleaning blade 11*a* and the cleaning container 13. Particularly, the under-cleaning blade seal 14 is a seal member for sealing (for preventing the toner from leaking out from) a gap between the cleaning blade 11*a* and the cleaning container 13 over a longitudinal direction of the cleaning container 13. Further, the vertical seals 15 and 16 as a first seal member are seal members for sealing the gap between the cleaning blade 11*a* and the cleaning container 13 in one end side and another end side, respectively, with respect to the longitudinal direction of the cleaning container 13. The end portion seals 19 and 20 as a second seal member are provided on the cleaning container 13 for sealing a gap between the photosensitive drum 7 and the cleaning container 13 in contact with longitudinal end portions of the photosensitive drum 7 in regions outside an image forming region.

The cleaning container 13 is provided with a fixing member 17 for fixing the receptor sheet 11*b* on the cleaning container 13. The cleaning container 13 corresponds to a frame, formed of a resin material, constituting the residual toner accommodating portion 11*c*. Further, the cleaning blade 11*a* is assembled with the cleaning container 13 to constitute the residual toner accommodating portion 11*c* together with the cleaning container 13. Further, the vertical seals 15 and 16 correspond to the seal member, and the end portion seals 19 and 20 correspond to the end portion seal member.

The under-cleaning blade seal 14 is provided and extended between blade mounting bearing surfaces 21 and 22 provided at longitudinal end portions of the cleaning container 13. The vertical seals 15 and 16 are provided in the neighborhood of the blade mounting bearing surfaces 21 and 22 in the longitudinal one end side and another end side of the cleaning container 13. The under-cleaning blade seal 14 and the vertical seals 15 and 16 are integrally injection-molded (injection molding) on the cleaning container 13 (frame) by using an elastic seal material.

Next, the vertical seals 15 and 16 will be described.

The vertical seals 15 and 16 are disposed symmetrically in the longitudinal one end side and another end side of the cleaning container 13, and constituent members relating to the vertical seals 15 and 16 are also symmetrical. Therefore, as the constitutions of the vertical seals 15 and 16, the constitution of the vertical seal 15 in one end side is described in some cases, but this is also true for the vertical seal 16.

As shown in FIGS. 5 and 6, the vertical seals 15 and 16 are provided in the neighborhood of the blade mounting bearing surfaces 21 and 22 as described above. Specifically, the vertical seals 15 and 16 are provided in contact with an opposite surface (back surface) of the cleaning blade 11*a* from a surface, where the cleaning blade 11*a* contacts the photosensitive drum 7, in regions outside of the image forming region of the photosensitive drum 7 with respect to the longitudinal direction of the cleaning container 13.

Further, positions where the vertical seals 15 and 16 are contacted to the cleaning blade 11*a* are located inside (toward the longitudinal central portion or the image forming region) longitudinal end portions of each of the rubber 11*a*1 and the metal plate portion 11*a*2 of the cleaning blade 11*a*. As a result, contact states of the vertical seals 15 and 16 with the cleaning blade 11*a* can be further stabilized.

Further, in order to prevent the toner from less passing between the vertical seal 15 and the end portion seal 19 and between the vertical seal 16 and the end portion seal 20, the vertical seals 15 and 16 are provided in longitudinal ranges where the end portion seals 19 and 20 are provided. That is, the vertical seals 15 and 16 are configured so that their longitudinal positions where they contact the cleaning blade 11*a* overlap with the disposition positions of the end portion seals 19 and 20.

Further, as shown in FIGS. 3 and 7, the vertical seal 15 has a shape such that it extends from the cleaning container 13 side toward the cleaning blade 11*a*. A portion, as a free end, of the vertical seal 15 contacting the cleaning blade 11*a* has the following shape. The shape is such that the portion is constituted by a first contact portion 15*a* contacting the rubber portion 11*a*1 of the cleaning blade 11*a* and a second contact portion 15*b* contacting the metal plate portion 11*a*2 of the cleaning blade 11*a*. The first and second contact portions 15*a* and 15*b* are continuously connected by an inclined surface 15*c* as a third contact portion, thus providing an integral shape. Thus, the vertical seal 15 includes the contact portions 15*a* and 15*b* and the inclined surface (inclined portion) 15*c*, which are integrally molded on the cleaning container 13. The contact portion 15*b* corresponds to a projected portion.

A boundary between the rubber portion 11*a*1 and the metal plate portion 11*a*2 of the cleaning blade 11*a* includes a stepped portion L1, and the inclined surface 15 is configured to range over the stepped portion L1 (the inclined surface 15*c* has a shape corresponding to the stepped portion L1). The stepped portion L1 is formed at the boundary between the rubber portion 11*a*1 and the metal plate portion 11*a*2 by partly covering the surface of the metal plate portion 11*a*2 with the rubber portion 11*a*1.

Further, a contact surface of the contact portion 15*a* and a contact surface of the contact portion 15*b* are configured to provide heights different from each other correspondingly to a shape of a stepped portion of a surface of the cleaning blade 11*a*. A contact surface of the inclined surface 15*c* constitutes an inclined surface connecting the contact surfaces of the contact portions 15*a* and 15*b*, different in height.

Thus, the contact portions 15*a* and 15*b* provided correspondingly to the rubber portion 11*a*1 and the metal plate portion 11*a*2 of the cleaning blade 11*a* are integrally formed, so that the vertical seals 15 and 16 can be provided on the cleaning container 13 with high accuracy. As a result, easy assembling with high accuracy can be effected, so that stabilization of a product function can be realized. Further, in this embodiment, the vertical seals 15 and 16 are molded with a resin material, such as an elastomer resin material (elastic member) and, therefore, compared with a conventional case wherein the foam urethane is used as the seal member, it becomes possible to improve a sealing property (sealing performance) and hermeticality.

Next, the inclined surface 15*c* will be described specifically with reference to FIG. 7, (a) and (b) of FIG. 13, and (a) and (b) of FIG. 14, which successively illustrate an operation for assembling the cleaning blade 11*a* with the cleaning container 13.

FIG. 7 is a schematic view showing a state, for illustrating a positional relation between the shapes of the contact portions of the cleaning blade 11*a* and the vertical seal 15, in which the cleaning blade 11*a* is offset from the vertical seal 15. Parts (a) and (b) of FIG. 13 and (a) and (b) of FIG. 14 are schematic views successively showing states of deformation of the inclined surface 15*c* in a process of the assembling operation of cleaning blade 11*a* with the cleaning container 13 in the order of (a) of FIG. 13, (b) of FIG. 13, (a) of FIG. 14, and (b) of FIG. 14. Part (b) of FIG. 14 shows the state in which the assembling of the cleaning blade 11*a* with the cleaning container 13 is completed and is the same as the state shown in FIG. 3.

In this embodiment, an angle θ formed between the rubber portion contact surface 11*a*4 of the rubber portion 11*a*1 and the inclined surface 15*c* was about twenty-eight degrees. A length (size) of the stepped portion L1 was about 0.5 mm, and a length L2 (distance or size of the stepped portion) between the two contact portions 15*a* and 15*b* of the vertical seal with respect to the arrow Z direction was about 0.8 mm. The rubber portion contact surface 11*a*4 constitutes the stepped portion L1 and does not contact the metal plate portion 11*a*2.

Part (a) of FIG. 13 shows the state in which a corner portion 11*a*6 of the rubber portion 11*a*1 of the cleaning blade 11*a* starts the contact with the inclined surface 15*c*. Part (b) of FIG. 13 and part (a) of FIG. 14 show the states in which the inclined surface 15*c* and the contact portions 15*a* and 15*b* are gradually compressed and deformed (compression deformation). The corner portion 11*a*6 projects toward the vertical seal (seal member) 15 side at the stepped portion L1 of the contact portions of the cleaning blade 11*a*. Further, the corner portion 11*a*6 is a portion constituting the stepped portion L1 (at an end portion of the rubber portion contact surface 11*a*4 in the metal plate portion 11*a*2 side).

In this embodiment, although details will be described later, as the material for the vertical seals 15 and 16, elastomer resin having elasticity is used.

Figure 14:
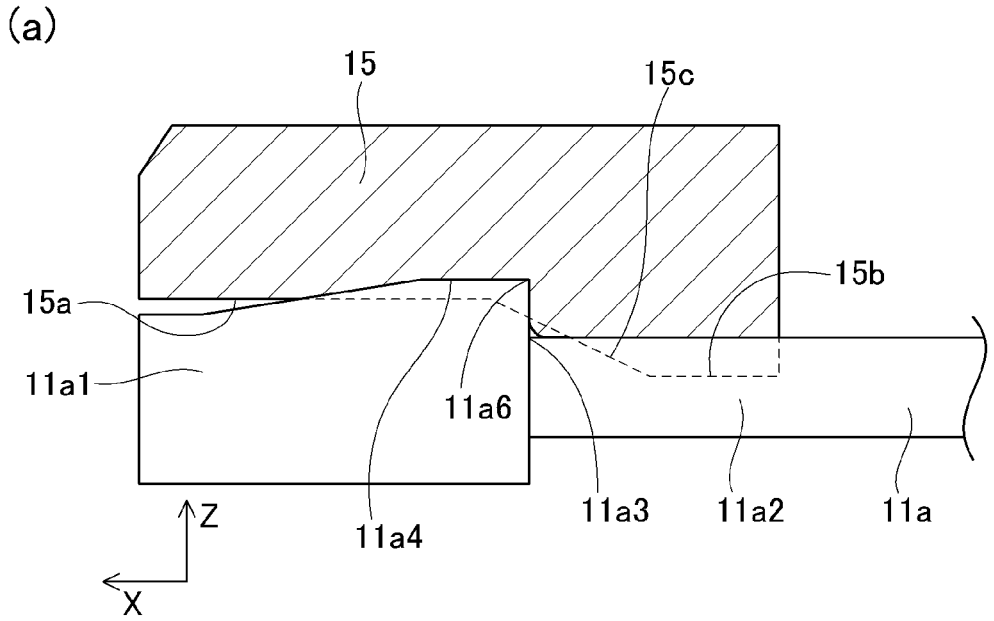
Figure 14:
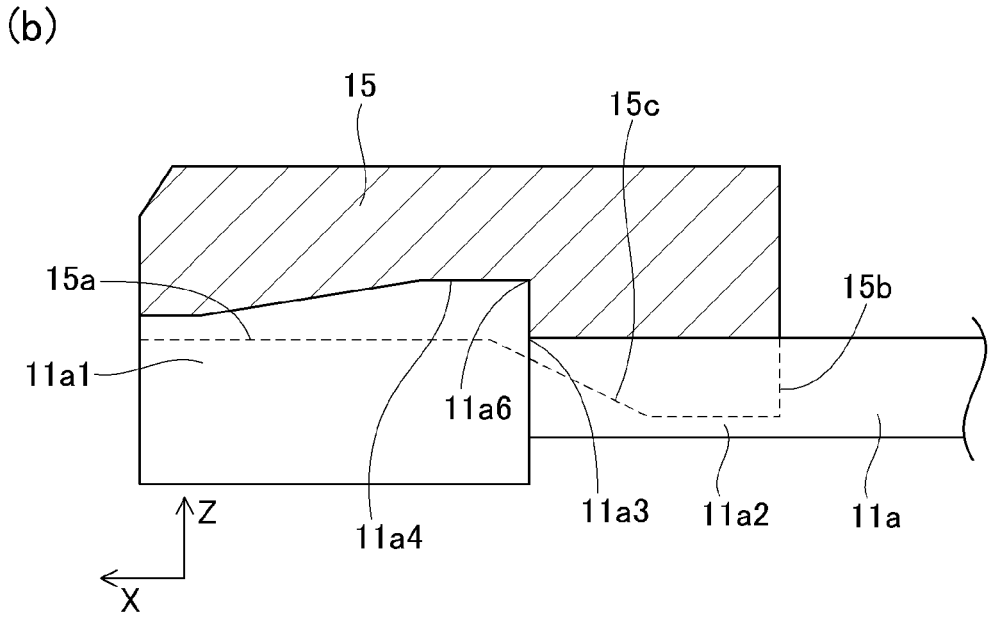

As shown in part (b) of FIG. 13 and part (a) of FIG. 14, the inclined surface 15*c* of the vertical seal 15 is compressed by the corner portion 11*a*6 and the portion of the rubber portion 11*a*1 constituting the stepped portion L1, so that the compressed portion of the inclined surface 15*c* is deformed toward a corner portion 11*a*3 constituting a space. The corner portion 11*a*3 (crossing portion) is constituted by a portion of the rubber portion 11*a*1 constituting the stepped portion L1 (end portion (surface) of the rubber portion 11*a*1 in the metal plate portion 11*a*2 side) and the metal plate portion 11*a*2.

The contact portion 15*b* is compressed, by the constitution of L1<L2, at the lower end of the inclined surface 15*c* by the metal plate portion 11*a*2. As a result, the compressed portion of the inclined surface 15*c* moves in an arrow X direction to fill the space of the corner portion 11*a*3. The lower end of the inclined surface 15*c* is a peripheral portion of the contact portion 15*b* and corresponds to a portion, of the third contact portion, located at a periphery of the second contact portion.

By the actions of these portions, with the assembling of the cleaning blade 11*a*, the inclined surface 15*c* of the vertical seal 15 is deformed to fill the space of the corner portion 11*a*3, thus finally filling substantially the space of the corner portion 11*a*3. Thus, the inclined surface 15*c* is constituted to contact the stepped portion L1 and the corner portion 11*a*3 (stepped portion peripheral portion) with no spacing. That is, in one longitudinal end side and another longitudinal end side of the cleaning container 13, the vertical seals 15 and 16 are configured to contact the cleaning blade 11*a* with no spacing. As a result, it becomes possible to keep a higher toner sealing property.

As described above, in order to deform the inclined surface 15*c*, it is preferable that the angle θ1 formed between the rubber portion contact surface 11*a*4 and the inclined surface 15*c* is in a range of 0 (degrees)≤θ1 90 (degrees) and the relationship of L1<L2 is satisfied.

With a smaller stepped portion L1, the space of the corner portion 11*a*3 is more easily filled and, thus, the toner sealing property is readily enhanced.

Figure 15:
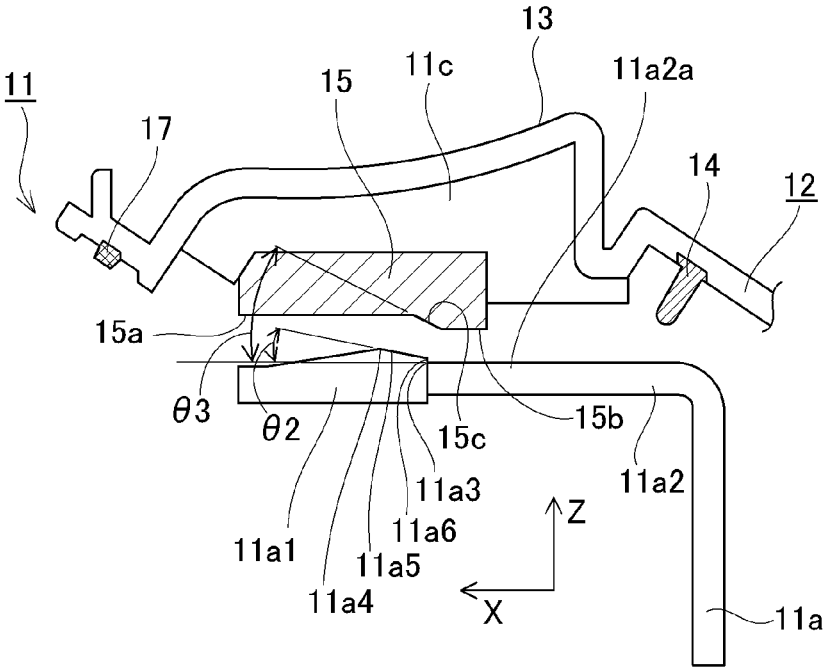

Here, an angle formed between the supporting portion 11*a*2*a* of the metal plate portion 11*a*2 to which the rubber portion 11*a*1 is attached and an inclined surface 11*a*5 of the rubber portion contact surface 11*a*4 is θ2, and an angle formed between the supporting portion 11*a*2 and the inclined surface 15*c* is θ3. Even in the case as shown in FIG. 15, when the angle θ3 is in a range of 0 (degrees)≤θ3<90 (degrees) and θ2<θ3, the space of the corner portion 11*a*3 can be similarly filled with the vertical seal 15, so that the higher toner sealing property can be maintained. The rubber portion contact surface 11*a*4 constitutes the stepped portion L1 and does not contact the metal plate portion 11*a*2.

Next, a constitution for improving the toner sealing property at a boundary between an end surface 15*d*, opposite from the inclined surface 15*c*, of the vertical seal 15 and the mounting bearing surface 22 as a fixing surface of the cleaning blade 11*a* (metal plate portion 11*a*2) will be described with reference to FIGS. 16 to 22.

Figure 16:
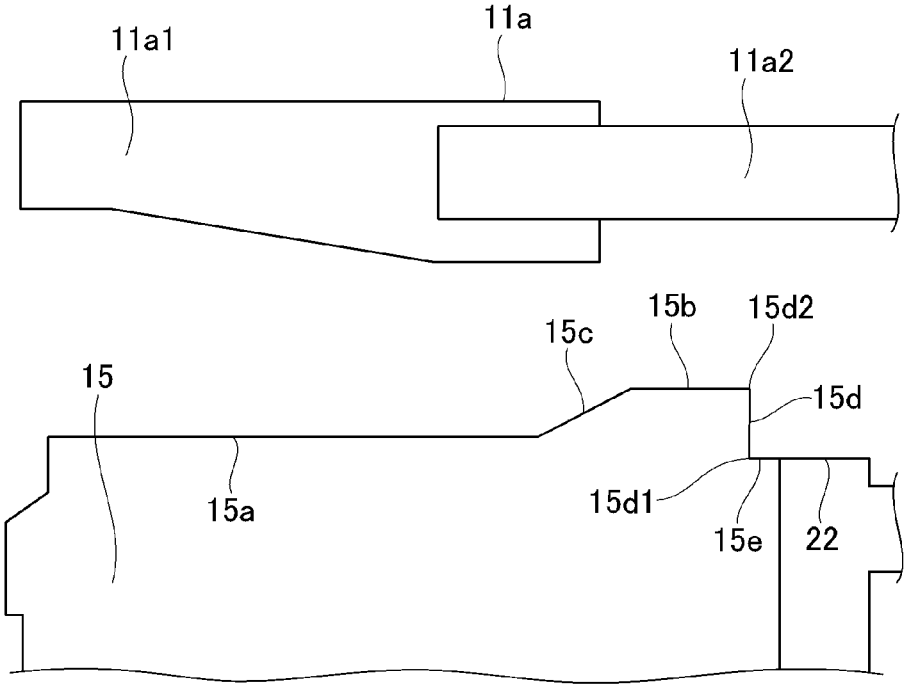
Figure 17:
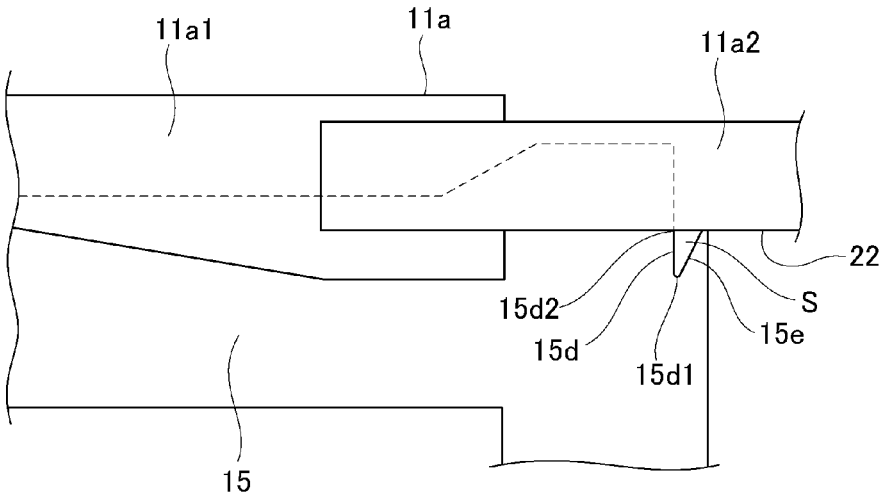

FIGS. 16 and 17 are schematic sectional views, each showing the vertical seal and its neighborhood of the cleaning frame unit 12, in this embodiment. FIG. 18 is a perspective view of the mounting bearing surface 22 of the cleaning blade 11*a* in this embodiment. FIG. 19 is an enlarged view of the mounting bearing surface 22 of the cleaning blade 11*a* in this embodiment. FIG. 20 is a perspective view showing the vertical seal and its neighborhood of the cleaning frame unit 12 in this embodiment. FIGS. 21 and 22 are schematic sectional views, each showing the vertical seal and its neighborhood of the cleaning frame unit 12, in this embodiment.

The mounting bearing surfaces 21 and 22 are provided at a wall portion 13*d* of the cleaning container 13. The end surface 15*d* corresponds to a side surface of the contact portion 15*b* in the mounting bearing surface 22 side (fixing surface side). In FIGS. 16 to 22, for convenience of explanation, compared with the preceding figures, the positional relation between the cleaning blade 11*a* and the vertical seal 15 is shown in an upside-down state.

The vertical seal 15 is, as described later, molded by injecting a melted resin material into a mold (not shown) contacted to the cleaning container 13.

At the boundary between the end surface 15*d* and the mounting bearing surface 22, there is a need to prevent the vertical seal 15 from running onto the mounting bearing surface 22 to obviate the influence on positional accuracy of the cleaning blade 11*a* with respect to a photosensitive drum contact position 11*a*11. Therefore, the entire mounting bearing surface 22 is required to be sealed by the metal mold with reliability. Also, the cleaning container 13, to which the metal mold is to be contacted, is the mold product and there is a variation in dimension to some extent, and, therefore, also in consideration of the variation, the contact surface of the metal mold is required to be made somewhat larger than an area of the mounting bearing surface 22.

As a result, the end portion 15*d* of the vertical seal 15 after the molding is located, at its boundary portion, at a position spaced (in a left direction) from the mounting bearing surface 22 as shown in FIG. 16, so that the vertical seal 15 is provided with a lower surface 15*e* as a fourth contact portion. As a result, the vertical seal 15 has an almost L-character shape by the end surface 15*d* and the lower surface 15*e*. The lower surface 15*e* corresponds to a flat surface (portion) where it is leveled with the mounting bearing surface 22 (in a state in which there is no stepped portion between two surfaces to form the flat (leveled) surface). The contact portion 15*b* projects from the lower surface 15*e* toward the metal plate portion 11*a*2.

The vertical seal 15 is shaped as described above, so that the end portion 15*d* of the vertical seal 15 can be prevented from running on the mounting bearing surface 22.

However, in the case when the cleaning blade 11*a* is mounted on the cleaning container 13 provided with the vertical seal 15 having such a shape, the following fact is empirically found. That is, it is empirically found that the vertical seal 15, compressed by the metal plate portion 11*a*2, is deformed as shown in FIG. 17 to provide a space S on the vertical seal 15, so that the toner sealing property cannot be maintained.

This reason will be described below.

The vertical seal 15 is shaped in the substantially L-character to form the corner portion 15*d*1, so that rigidity of the substantially L-character shaped portion (a corner peripheral portion including the corner portion 15*d*1) is higher than that at another portion. For this reason, when the vertical seal 15 is compressed by the metal plate portion 11*a*2, the substantially L-character shaped portion is liable to sink into the inside of the vertical seal (seal member) 15 while keeping the L-character shape. By the sinking of the L-shaped portion, a volume of the seal member (resin material) inside the vertical seal 15 is increased, but the resin material present in the sinking region of the L-shaped portion is deformed and moved in the longitudinal left-right direction. For this reason, the resin material at the L-shaped portion of the vertical seal 15 (at the periphery of the corner portion of the L-shaped portion) sinks into the inside of the vertical seal 15, while leaving the space, and as a result, it would be considered that a spacing S is generated.

In this embodiment, a seal structure, i.e., a shape in the frame side and a shape of the seal member integrally formed with the frame were optimized.

That is, when the cleaning blade 11*a* is assembled with the cleaning container 13, in order to prevent the spacing S from being generated, as shown in FIG. 17, the wall portion 13*d* of the cleaning container 13 was provided with a recessed portion 22*a* where the mounting bearing surface 22 is partly recessed. Further, as shown in FIG. 20, the vertical seal 15 was shaped so that the corner portion 15*d*1 and the lower surface 15*e* entered the recessed portion 22*a*. In FIG. 19, the recessed portion 22*a* is shown in an enlarged manner.

The recessed portion 22*a* forms a narrow space defined by four surfaces (limiting surfaces) 22*a*1, 22*a*2, 22*a*3, and 22*a*4. In this embodiment, dimensions of the recessed portion 22*a* where L3=0.8 mm, L4=3 mm and L5=0.5 mm. The molded product of the vertical seal 15 on the cleaning container 13 was shown in FIG. 20 as a perspective view and in FIG. 21 as a principal sectional view. In these figures, dimensions of the vertical seal 15 were L6=0.3 mm, A1=2 mm, A2 (=L4)=3 mm, B1 (=L5)=0.5 mm, and B2=1.2 mm.

L3 is a length (width) of the recessed portion 22*a* with respect to a direction perpendicular to the longitudinal direction of the mounting bearing surface 22. L4 is a length (width) of the recessed portion 22*a* with respect to the longitudinal direction (longitudinal distance between the surfaces 22*a*1 and 22*a*3). L5 is a length from the mounting bearing surface 22 to the surface 22*a*4 in the direction perpendicular to the mounting bearing surface 22 (depth of the recessed portion 22*a*). L6 is a length (width) of the lower surface 15*e* as the fourth contact portion with respect to the direction perpendicular to the longitudinal direction of the mounting bearing surface 22. A1 is a length of the contact portion 15*b* with respect to the longitudinal direction. A2 is a length of the lower surface 15*e* with respect to the longitudinal direction and is equal to L4. B1 is a length from the lower surface 15*e* to the surface 22*a*4 with respect to the direction perpendicular to the mounting bearing surface 22. B2 is a projection height of the contact portion 15*b* from the lower surface 15*e* with respect to the direction perpendicular to the mounting bearing surface 22. The surface 22*a*4 is the bottom surface.

When the cleaning blade 11*a* is assembled with the cleaning container 13, on which the vertical seal 15 is molded, and then the vertical seal 15 is compressed, the corner portion 15*d*1 is liable to sink into the inside of the seal member, similarly as described above.

However, the periphery of the corner portion 15*d*1 is surrounded by the four surfaces of the recessed portion 22*a* and, therefore, the seal member present in the region in which the L-shaped portion sinks is regulated (limited) in escaping space, so that the seal member is compressed in the recessed portion 22*a*.

Thus, pressure of the seal member inside the recessed portion 22*a* becomes high and, therefore, rigidity is higher than that in the case when the space is generated at the corner portion 15*d*1, as shown in FIG. 17, as described above, so that the entire volume of the recessed portion 22*a* can be filled with the seal member. Therefore, it is possible to prevent the spacing S from being generated between the vertical seal 15 and the metal plate portion 11*a*2 (FIG. 22).

As described above, the recessed portion 22*a* is provided with the surfaces (preventing surfaces) 22*a*1, 22*a*2, 22*a*3, and 22*a*4 for preventing the resin material, of the resin material constituting the vertical seal 15, present in the region in which the L-shaped portion sinks from being moved when the L-shaped portion sinks. As a result, during the assembling of the cleaning blade 11*a* with the cleaning container 13, the contact portion 15*b* is contacted to the metal plate portion 11*a*2 and is compressed and deformed. Thus, when the L-shaped portion sinks into the vertical seal 15, the spacing cannot be generated between the vertical seal 15 and the metal plate portion 11*a*2. Therefore, the toner sealing property can be satisfactorily maintained at the boundary between the vertical seal 15 and the mounting bearing surface 22 for fixing the cleaning blade 11*a*.

In order to less generate the spacing S, the volume of the recessed portion 22*a* may desirably be minimized, so that the sinkable height B1 of the vertical seal 15 may desirably be smaller than the compression height (projection height) B2 of the vertical seal 15 (FIG. 21).

At the same time, in order to also prevent the end portion 15*d* of the vertical seal 15 from running onto the mounting bearing surface 22, $0<L6<L3$ and $A1<A2$ may desirably be satisfied. By such setting, all the peripheral portion of the boundary 15*d*1 can be made into an almost L-character shape, so that it is possible to prevent the end portion 15*d* of the vertical seal 15 from running onto the mounting bearing surface 22.

Further, as shown in FIG. 23, when an upper end 15*d*2 of the vertical seal 15 is moved toward the rubber portion 11*a* and an end surface 15*d* is provided with an inclined surface, a compression volume of the vertical seal 15 at the recessed portion 22*a* can be reduced. As a result, a repelling force by the compression of the vertical seal 15 can be suppressed and the cleaning blade 11*a* can be further stably mounted, thus being preferable.

Further, as shown in FIG. 8, the vertical seals 15 and 16 have a shape such that they extend from the cleaning container 13 toward the cleaning blade 11*a* and are inclined from the contact surface of the cleaning blade 11*a* with respect to the longitudinal direction of the cleaning container 13 (rotational axis direction of the photosensitive drum 7). When the vertical seals 15 and 16 are not inclined with respect to the longitudinal direction, the vertical seals 15 and 16 are vertically contacted to the cleaning blade 11*a*. In such a case, there is a possibility that a repelling force (contact pressure) of the cleaning blade 11*a* against the rubber portion 11*a*1 of the cleaning blade 11*a* is generated during the contact of the vertical seals 15 and 16 with the cleaning blade 11*a*. Further, in the case when the vertical seals 15 and 16 are vertically contacted to the cleaning blade 11*a*, there is a possibility that the vertical seals are compressed and buckled depending on an amount of contact and, thus, the contact pressure becomes unstable.

In this embodiment, the vertical seals 15 and 16 are configured to have the inclined shape with respect to the longitudinal direction, so that the vertical seals 15 and 16 are contacted to the cleaning blade 11*a* with an angle where they are inclined from the cleaning blade 11*a*. As a result, when the cleaning blade 11*a* is mounted on the cleaning container 13, the vertical seals 15 and 16 are contacted to the cleaning blade 11*a*, thus being deformed so as to be bent. Therefore, the repelling force of the vertical seals 15 and 16 against the rubber portion 11*a*1 of the cleaning blade 11*a*, generated when the vertical seals 15 and 16 are contacted to the cleaning blade 11*a*, can be minimized.

As a result, with respect to the longitudinal direction, a difference in contact pressure, of the rubber portion 11*a*1 of the cleaning blade 11*a* applied to the photosensitive drum 7, between the end portions where the vertical seals 15 and 16 are provided and other portions (intermediate portions between the end portions and the central portion) can be made small. Thus, it is possible to make uniform and to stabilize a cleaning property of the surface of the photosensitive drum 7 with respect to the longitudinal direction.

The inclined direction of the vertical seals 15 and 16 may be either of an inward direction (an arrow direction shown in (a) of FIG. 8) of the cleaning container 13 and an outward direction (an arrow direction shown in (b) of FIG. 8) of the cleaning container 13 in the longitudinal direction, since a similar effect of reducing the repelling force can be obtained. When the contact positions of the vertical seals 15 and 16 with the cleaning blade 11*a* with respect to the longitudinal direction, i.e., compactness (downsizing) of the lengths of the cleaning container 13 and the cleaning blade 11*a* with respect to the longitudinal direction are taken into consideration, the inwardly inclined shape is desirable.

Also, from the viewpoint of the toner sealing, it would be considered that the inwardly inclined shape is preferred. That is, when the vertical seals 15 and 16 are inwardly inclined, the vertical seals 15 and 16 are contacted to the cleaning blade 11*a* in an inclined state in a counter direction to a flow out direction of the toner to the outside and, therefore, it would be considered that the toner sealing property is good.

The inclined shape of the vertical seals 15 and 16 may be formed at only a portion where the vertical seals are contacted to the rubber portion 11*a*1 of the cleaning blade 11*a*, but a similar shape may also be formed at a portion where the vertical seals are contacted to the metal plate portion 11*a*2.

Further, the vertical seals 15 and 16 are different in color from the cleaning container 13. That is, the vertical seals 15 and 16 are formed of a resin material different in color from the resin material for the cleaning container 13.

As a result, in a checking step as to whether or not the vertical seals 15 and 16 are molded with reliability after the formation of the seals on the cleaning container 13 described later, viewability (visibility) can be made satisfactory. Therefore, accuracy of the checking step can be improved and the checking step (manufacturing step) can be simplified.

In this embodiment, as the elastic seal material, an elastomer resin material is used. As the elastomer resin material, styrene based elastomer resin material, which is the same type as the resin material for the cleaning container 13 and has elasticity, may preferably be used, since it is excellent in a disassembling operation property during recycling of the process cartridge B, that is, when the same material parts are not required to be disassembled.

However, another elastomer resin material may also be used as long as it has a similar mechanical characteristic, and it is also possible to use a silicone based rubber or a soft rubber. In this embodiment, the various elastomer resin materials described above, rubbers, and the like, as the elastic seal material are inclusively referred to as an "elastomer resin".

(Molding Step on Cleaning Container)

A molding step for molding the vertical seals 15 and 16 on the cleaning container 13 will be described with reference to FIGS. 9 to 12.

FIG. 9 is a schematic perspective view showing an injection port (injection portion) of the cleaning container in this embodiment, FIG. 10 is a schematic perspective view showing a state in which the cleaning container in this embodiment is set in a resin material injection device, FIG. 11 is a schematic sectional view showing a state in which injection molding of the resin material on the cleaning container in this embodiment is made, and FIG. 12 is a schematic sectional view showing a state after the injection molding of the resin material on the cleaning container in this embodiment is made. Incidentally, in this embodiment, in addition to the vertical seals 15 and 16, the under-cleaning blade seal 14 also is molded in the same molding step.

As shown in FIGS. 9, 10, and 11, the cleaning container 13 is provided with an injection port 25 which is a (melted) resin injection portion, into which a melted resin material injected for molding the under cleaning blade seal 14 flows. The injection port 25 is provided in an opposite side of the cleaning container (cleaning container back side) having a mold contact surface 13*a* to which an under blade seal mold 50, which is provided with a seal shape of the under cleaning blade seal 14, is to be contacted during molding, and communicates with the mold contact surface 13*a*.

Similarly, the cleaning container 13 is provided with injection ports 26 and 27 for permitting molding of the vertical seals 15 and 16 at a longitudinal end portion and another end portion of the cleaning container 13. The injection ports 26 and 27 are provided in an opposite side of the cleaning container having mold contact surfaces 13*b* and 13*c*, to which vertical seal molds 51 and 52, which are metal molds provided with seal shapes of the vertical seals 15 and 16, are to be contacted during molding, and communicate with the mold contact surfaces 13*b* and 13*c*, respectively.

In this embodiment, gates 41, 42, and 43 are provided at positions corresponding to positions of the injection ports 25, 26, and 27, respectively, so that ejection directions are the same as open directions of the respective injection ports. This will be described later in detail.

In this embodiment, the injection ports 25, 26, and 27, provided on the cleaning container 13, are disposed so that they are different in longitudinal position and, thus, they are deviated from each other with respect to the longitudinal direction of the cleaning container 13.

Next, a molding step will be described.

First, as shown in FIG. 10, the cleaning container 13 is set in the resin material injection device 40. The resin material injection device 40 includes a hopper portion 46 for supplying the resin material to the under-cleaning blade seal 14 and the vertical seals 15 and 16. In this case, as shown in FIG. 11, the under-blade seal mold 50 is clamped to the contact surface 13*a* in a state in which it is contacted to the contact surface 13*a* with the under-cleaning blade seal 14. Similarly, the vertical seal molds 51 and 52 are contacted and clamped to the contact surfaces 13*b* and 13*c* with the vertical seals 15 and 16.

The respective molds 50, 51, and 52 may be successively contacted and clamped to the cleaning container 13, or may also be concurrently contacted and clamped to the cleaning container 13. Each of the molds 50, 51, and 52 is in the contact state, so as to cause the leakage of the resin material in an injection step described later.

Then, to the injection ports 25, 26, and 27 provided on the cleaning container 13, the gates 41, 42, and 43 of the resin material injection device 40 are contacted, respectively, from above, as shown in FIG. 9. In this embodiment, the respective injection ports are disposed in the same direction side of the cleaning container 13, and the mold contact surfaces 13*a*, 13*b*, and 13*c* are disposed in the same direction side of the cleaning container 13. As a result, a plurality of parts can be concurrently molded in the same step and, thus, it is possible to realize a reduction in number of assembling steps without decreasing the number of the parts and shortening of a part-molding time (tact time) of a plurality of part-molding steps themselves, so that it becomes possible to realize a reduction in product cost by an increase in manufacturing efficiency and the reduction in number of the assembling steps. Further, the gates 41, 42, and 43 can be contacted to the cleaning container 13 at the same time and, thus, injection operations can be concurrently effected, so that injection end times of all of the parts can be shortened.

Then, plungers 55, 56, and 57 of the resin material injection device 40 are driven in an arrow direction shown in FIG. 11, so that the elastomer resin material as the seal material for the under-cleaning blade seal 14 and the vertical seals 15 and 16 are injected from the gates 41, 42, and 43. The injected elastomer resin material (different from the resin material for the cleaning container 13) is caused to flow into a space defined by the cleaning container 13, the under-blade seal mold 50, and the vertical seal molds 51 and 52.

The under-cleaning blade seal 14 and the vertical seals 15 and 16 may be molded by successively injecting the elastomer resin materials from the associated gates, but by employing a constitution in which the resin materials are concurrently injected from the gates, as described above, it is possible to effect the injection operations at the same time.

After the injection, the cleaning container 13 is taken out. At this time, as shown in FIG. 12, the cleaning container 13 is retracted from the gates 41, 42, and 43 of the resin material injection device 40, in a downward direction in FIG. 12. Then, as shown in FIG. 12, the cleaning container 13 is retracted in an arrow R direction from the under-blade seal mold 50 and the vertical seal molds 51 and 52. The arrow R direction is a parting direction in which there is no undercut portion with respect to shapes of the molded under-cleaning blade seal 14, thus being different from a parting direction of the cleaning container 13 (the up-down direction in FIG. 12). Thus, by retracting the cleaning container 13 in the arrow R direction, in a state in which the under-cleaning blade seal 14 and the vertical seals 15 and 16 are molded on the cleaning container 13, the cleaning container 13 can be taken out.

According to this embodiment, by the molding step as described above, the under-cleaning blade seal 14, and the vertical seals 15 and 16, can be integrally molded. As a result, the under-cleaning blade seal 14 and the vertical seals 15 and 16 can be provided on the cleaning container 13 with a high accuracy, so that high-accuracy and easy assembling can be effected and, thus, stabilization of product function can be realized. Further, by the improvement in assembling property of the seal member, the toner sealing property can be improved and, in addition, production efficiency can be enhanced and an assembling cost can be reduced, so that a product cost can be reduced.

Further, the plurality of parts (members), such as the under-cleaning blade seal 14 and the vertical seals 15 and 16, can be manufactured in the same step by using the above-described resin material injection device 40.

That is, the plurality of parts different in function can be manufactured in the same step, so that a reduction in assembling step, an increase in manufacturing efficiency thereby, and a reduction in product cost by the reduction in assembling step can be realized.

Further, in one longitudinal end portion and another longitudinal end portion of the cleaning container 13, in this embodiment, the shape of the seal structure, i.e., the shape of the frame and the shape of the seal member integrally molded with the frame, can be optimized. As a result, the vertical seals 15 and 16 can be contacted to the cleaning container 13 with no spacing. Thus, the toner sealing property in the gap between the cleaning container 13 and the cleaning blade 11*a* can be improved.

In this embodiment, a case in which the features of the present invention are applied to the photosensitive drum unit 11 is described, but such a constitution may also be applied to the developing unit 10. That is, the developing roller 10*d* may be used as the rotatable member capable of carrying thereon the toner, and the developing blade 10*e* may be used as the blade member. Further, vertical seals may be provided in one longitudinal end side and another longitudinal end side of the developing unit 10 so as to prevent the toner from leaking out from the gap between the developing blade 10*e* and the developing frame 10*g* constituting the toner accommodating portion 10*a* of the developing unit 10.

While the invention has been described with reference to the structures disclosed herein, it is not confined to the details set forth and this application is intended to cover such modifications or changes as may come within the purpose of the improvements or the scope of the following claims.

What is claimed is:

1. A cartridge detachably mountable to a main assembly of an image forming apparatus, the cartridge comprising:

a rotatable member;

a blade member, including a rubber portion, contacted to said rotatable member, and a metal plate portion supported to said blade member;

a frame, formed of a resin material, for supporting said blade member; and a seal member, extending in a direction crossing an axial direction of said rotatable member, provided on said frame to be contacted to a portion of said rubber portion and said metal plate portion, wherein said seal member is formed on said frame by injection molding for sealing a gap between said blade member and said frame, wherein said rotatable member is an image bearing member for forming an electrostatic latent image on its surface, wherein said rubber portion has a corner portion formed as a stepped portion at a boundary between itself and said metal plate portion and removes developer in contact with said surface of said image bearing member, and wherein said seal member further includes a third contact portion contacted to said corner portion, constituting an inclined surface for connecting a first contact portion and a second contact portion, which are different in height.

2. A cartridge according to claim 1, wherein said seal member is molded in an inclined shape with respect to the axial direction.

3. A cartridge according to claim 1, wherein said seal member is configured so that its position at which it contacts said blade member with respect to the axial direction is located inside end portions of said rubber portion and said metal plate portion.

4. A cartridge according to claim 1, further comprising a second seal member, provided on said frame, for sealing a gap between said image bearing member and said frame, in contact with said image bearing member, in a free end side of said blade crossing an axial direction of said seal member, wherein said seal member is configured so that its position at which it contacts said blade member overlaps, with respect to the axial direction, with a position at which said second seal member is provided.

5. A cartridge according to claim 1, wherein said seal member is formed of a resin material different in color from a resin material for said frame.

6. A cartridge according to claim 1, wherein, when an angle formed between a supporting surface of said metal plate portion for supporting said rubber portion and a surface, of two surfaces of said rubber portion constituting said corner portion, which is free from contacting said metal plate portion is $\theta 2$, and an angle formed between said supporting surface and said surface of said rubber portion is $\theta 3$, the relations 0 (degrees)$\leq\theta\leq$90 (degrees) and $\theta 2<\theta 3$ are satisfied.

7. A cartridge according to claim 1, wherein said frame has a fixing surface, at which said metal plate portion of said blade member is fixed, partly provided with a recessed portion, wherein said seal member further includes a fourth contact portion, contacted to said metal plate portion, entering said recessed portion and being recessed more than said second contact portion in a state in which said blade member is demounted from said fixing surface, and wherein said recessed portion prevents deformation of said fourth contact portion, so as not to generate a gap between itself and said fourth contact portion, in a state in which said blade member is mounted on said fixing surface.

8. A cartridge according to claim 7, wherein said fourth contact portion has the same height as that of said fixing surface.

9. A cartridge according to claim 7, wherein a depth of said recessed portion from said fixing surface is less than a height of said second contact portion from said fixing surface with respect to a direction perpendicular to said fixing surface.

10. A cartridge according to claim 1, wherein said seal member is provided on said frame in each of one end side and another end side of said blade member with respect to the axial direction.

11. A cartridge according to claim 1, wherein said seal member has elasticity.

12. A cartridge according to claim 1, wherein said seal member is formed of an elastic resin material.

13. A unit for use with an image forming apparatus, the unit comprising:

a blade member, including a rubber portion, contacted to a rotatable member, and with a metal plate portion supported to said blade member;

a frame, formed of a resin material, for supporting said blade member; and a seal member, extending in a direction crossing an axial direction of said rotatable member, provided on said frame to be contacted to a portion of said rubber portion and said metal plate portion, wherein said seal member is formed on said frame by injection molding for sealing a gap between said blade member and said frame, wherein said rotatable member is an image bearing member for forming an electrostatic latent image on its surface, wherein said rubber portion has a corner portion formed as a stepped portion at a boundary between itself and said metal plate portion and removes developer in contact with said surface of said image bearing member, and wherein said seal member further includes a third contact portion contacted to said corner portion, constituting an inclined surface for connecting a first contact portion and a second contact portion, which are different in height.

14. A unit according to claim 13, wherein said seal member is molded in an inclined shape with respect to the axial direction.

15. A unit according to claim 13, wherein said seal member is configured so that its position at which it contacts said blade member with respect to the axial direction is located inside end portions of said rubber portion and said metal plate portion.

16. A unit according to claim 13, further comprising a second seal member, provided on said frame, for sealing a gap between said image bearing member and said frame, in contact with said image bearing member with respect to the axial direction, wherein said seal member is configured so that its position at which it contacts said blade member overlaps, with respect to the axial direction, with a position at which said second seal member is provided.

17. A unit according to claim 13, wherein said seal member is formed of a resin material different in color from a resin material for said frame.

18. A unit according to claim 13, wherein, when an angle formed between a supporting surface of said metal plate portion for supporting said rubber portion and a surface, of two surfaces of said rubber portion constituting said corner portion, which is free from contacting said supporting portion is $\theta 2$, and an angle formed between said supporting surface and said surface of said blade rubber portion is $\theta 3$, relations 0 (degrees)$\leq\theta 3\leq$90 (degrees) and $\theta 2<\theta 3$ are satisfied.

19. A unit according to claim 13, wherein said frame has a fixing surface, at which said metal plate portion of said blade member is fixed, partly provided with a recessed portion, wherein said seal member further includes a fourth contact portion, contacted to said metal plate portion, entering said recessed portion and being recessed more than said second contact portion in a state in which said blade member is demounted from said fixing surface, and wherein said recessed portion prevents deformation of said fourth contact portion so as not to generate a gap between itself and said fourth contact portion, in a state in which said blade member is mounted on said fixing surface.

20. A unit according to claim 19, wherein said fourth contact portion has the same height as that of said fixing surface.

21. A unit according to claim 19, wherein a depth of said recessed portion from said fixing surface is less than a height of said second contact portion from said fixing surface with respect to a direction perpendicular to said fixing surface.

22. A unit according to claim 13, wherein said seal member is provided on said frame in each of one end side and another end side of said blade member with respect to the axial direction.

23. A unit according to claim 13, wherein said seal member has elasticity.

24. A unit according to claim 13, wherein said seal member is formed of an elastic resin material.

25. A cartridge detachably mountable to a main assembly of an image forming apparatus, the cartridge comprising:

a rotatable member;

a blade member, including a blade contacted to said rotatable member and a supporting portion supported to said blade, wherein said supporting portion has an exposed surface that is not covered with said blade, and said blade has a stepped portion that is stepped relative to said exposed surface with respect to a thickness direction thereof;

a frame, formed of a resin material, for supporting said blade member; and a seal member, extending in a direction crossing in an axial direction of said rotatable member, provided over the stepped portion on said frame to be contacted to a portion of said blade and said supporting portion, wherein said seal member is formed on said frame by injection molding for sealing a gap between said blade member and said frame, wherein said rotatable member is an image bearing member for forming an electrostatic latent image on it surface, wherein said blade has a corner portion formed as a stepped portion at a boundary between itself and said supporting portion and removes developer in contact with said surface of said image bearing member, and wherein said seal member further includes a third contact portion contacted to said corner portion, constituting an inclined surface for connecting a first contact portion and a second contact portion, which are different in height.

26. A cartridge according to claim 25, wherein said seal member is molded in an inclined shape with respect to the axial direction.

27. A cartridge according to claim 25, wherein said seal member is formed of a resin material different in color from a resin material for said frame.

28. A cartridge according to claim 25, wherein said seal member is provided on said frame in each of one end side and another end side of said blade member with respect to the axial direction.

29. A cartridge according to claim 25, wherein said blade is formed of rubber.

30. A cartridge according to claim 25, wherein said seal member has elasticity.

31. A cartridge according to claim 25, wherein said seal member is formed of an elastic resin material.

32. A cartridge according to claim 25, wherein said seal member is configured so that its position at which it contacts said blade member with respect to the axial direction is located inside end portions of said blade and said supporting portion.

33. A cartridge according to claim 25, further comprising a second seal member, provided on said frame, for sealing a gap between said image bearing member and said frame in contact with said image bearing member, in a free end side of said blade crossing an axial direction of said seal member, wherein said seal member is configured so that its position at which it contacts said blade member overlaps, with respect to the axial direction, with a position at which said second seal member is provided.

34. A cartridge according to claim 25, wherein, when an angle formed between a supporting surface of said supporting portion for supporting said blade and a surface, of two surfaces of said blade constituting said corner portion, which is free from contacting said supporting portion is $\theta 2$, and an angle formed between said supporting surface and said surface of said blade is θ3, relations 0 (degrees)≤θ3≤90 (degrees) and θ2<θ3 are satisfied.

35. A cartridge according to claim 25, wherein said frame has a fixing surface, at which said supporting portion of said blade member is fixed, partly provided with a recessed portion, wherein said seal member further includes a fourth contact portion contacted to said supporting portion, entering said recessed portion and being recessed more than said second contact portion in a state in which said blade member is demounted from said fixing surface, and wherein said recessed portion prevents deformation of said fourth contact portion so as not to generate a gap between itself and said fourth contact portion in a state in which said blade member is mounted on said fixing surface.

36. A cartridge according to claim 35, wherein said fourth contact portion has the same height as that of said fixing surface.

37. A cartridge according to claim 35, wherein a depth of said recessed portion from said fixing surface is less than a height of said second contact portion from said fixing surface with respect to a direction perpendicular to said fixing surface.

38. A unit for use with an image forming apparatus, the unit comprising:

a rotatable member;

a blade member, including a blade contacted to said rotatable member and a supporting portion supported to said blade, wherein said supporting portion has an exposed surface that is not covered with said blade, and wherein said blade has a stepped portion stepped relative to said exposed surface with respect to a thickness direction thereof;

a frame, formed of a resin material, for supporting said blade member; and a seal member, extending in a direction crossing an axial direction of said rotatable member so as to contact said rotatable member, provided over a stepped portion on said frame to be contacted to a portion of said blade and said supporting portion, wherein said seal member is formed on said frame by injection molding for sealing a gap between said blade member and said frame, wherein said rotatable member is an image bearing member for forming an electrostatic latent image on its surface, wherein said blade member has a corner portion formed as a stepped portion at a boundary between itself and said supporting portion and removes developer in contact with said surface of said image bearing member, and wherein said seal member further includes a third contact portion contacted to said corner portion, constituting an inclined surface for connecting a first contact portion and a second contact portion, which are different in height.

39. A unit according to claim 38, wherein said seal member is molded in an inclined shape with respect to the axial direction.

40. A unit according to claim 39, wherein said seal member is configured so that its position at which it contacts said blade member with respect to the axial direction is located inside end portions of said blade and said supporting portion.

41. A unit according to claim 38, further comprising a second seal member, provided on said frame, for sealing a gap between said image bearing member, in a free end side of said blade crossing an axial direction of said seal member, wherein said seal member is configured so that its position at which it contacts said blade member overlaps, with respect to the axial direction, with a position at which said second seal member is provided.

42. A unit according to claim 38, wherein said seal member is formed of a resin material different in color from a resin material for said frame.

43. A unit according to claim 38, wherein, when an angle formed between a supporting surface of said supporting portion for supporting said blade and a surface, of two surfaces of said blade constituting said corner portion, which is free from contacting said supporting portion is θ2, and an angle formed between said supporting surface and said surface of said blade is θ3, relations 0 (degrees)≤θ3≤90 (degrees) and θ2<θ3 are satisfied.

44. A unit according to claim 38, wherein said frame has a fixing surface, at which said supporting portion of said blade member is fixed, partly provided with a recessed portion, wherein said seal member further includes a fourth contact portion, contacted to said supporting portion, entering said recessed portion and being recessed more than said second contact portion in a state in which said blade member is demounted from said fixing surface, and wherein said recessed portion prevents deformation of said fourth contact portion so as not to generate a gap between itself and said fourth contact portion in a state in which said blade member is mounted on said fixing surface.

45. A unit according to claim 44, wherein said fourth contact portion has the same height as that of said fixing surface.

46. A unit according to claim 44, wherein a depth of said recessed portion from said fixing surface is less than a height of said second contact portion from said fixing surface with respect to a direction perpendicular to said fixing surface.

47. A unit according to claim 38, wherein said seal member is provided on said frame in each of one end side and another end side of said blade member with respect to the axial direction.

48. A unit according to claim 38, wherein said blade is formed of rubber.

49. A unit according to claim 38, wherein said seal member has elasticity.

50. A unit according to claim 38, wherein said seal member is formed of an elastic resin material.

* * * * *